US010505287B2

(12) United States Patent
Sato et al.

(10) Patent No.: US 10,505,287 B2
(45) Date of Patent: Dec. 10, 2019

(54) CRIMP TERMINAL AND CRIMP TERMINAL MANUFACTURING METHOD

(71) Applicant: Yazaki Corporation, Tokyo (JP)

(72) Inventors: Kei Sato, Makinohara (JP); Kazuhide Takahashi, Makinohara (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 16/424,045

(22) Filed: May 28, 2019

(65) Prior Publication Data

US 2019/0280400 A1 Sep. 12, 2019

Related U.S. Application Data

(63) Continuation of application No. PCT/JP2017/016503, filed on Apr. 26, 2017.

(30) Foreign Application Priority Data

Dec. 27, 2016 (JP) ..... 2016-253771

(51) Int. Cl.
*H01R 4/18* (2006.01)
*H01R 4/70* (2006.01)
(Continued)

(52) U.S. Cl.
CPC ..... *H01R 4/185* (2013.01); *H01R 4/62* (2013.01); *H01R 4/70* (2013.01); *H01R 43/048* (2013.01); *H01R 43/16* (2013.01)

(58) Field of Classification Search
CPC ..... H01R 4/184; H01R 4/185; H01R 4/188; H01R 4/62; H01R 13/52
(Continued)

(56) References Cited

U.S. PATENT DOCUMENTS 8,900,010 B2 * 12/2014 Aoki ..... H01R 4/185 439/587
2005/0227549 A1 * 10/2005 Takayama ..... H01R 4/185 439/851
(Continued)

FOREIGN PATENT DOCUMENTS

JP 2015-201269 A 11/2015
JP 5940198 B2 6/2016
(Continued)

OTHER PUBLICATIONS

International Search Report for PCT/JP2017/016503 dated Aug. 1, 2017 [PCT/ISA/210].

*Primary Examiner* — Hien D Vu
(74) *Attorney, Agent, or Firm* — Sughrue Mion, PLLC

(57) ABSTRACT

The present invention makes production less difficult and ensures the waterproofness of a site of contact with an aluminum core wire. According to the present invention, a barrel section of a crimp terminal: has an inner barrel piece and an outer barrel piece; and an inner surface thereof is provided with a plurality of concave sections. A seal member that is formed from an adhesive gel sheet is affixed across a first region, a second region, and a third region and, after crimping, seals: between the inner barrel piece and the outer barrel piece; between a covered portion and the barrel section; and an opening that is on a terminal section side of the barrel section. The seal member is divided over the course of a path that goes from the second region through the first region to the third region.

5 Claims, 35 Drawing Sheets

(51) Int. Cl.
*H01R 43/048* (2006.01)
*H01R 43/16* (2006.01)
*H01R 4/62* (2006.01)

(58) Field of Classification Search
USPC ..... 439/877, 878
See application file for complete search history.

(56) References Cited

U.S. PATENT DOCUMENTS

| | | | | |
|---|---|---|---|---|
| 2013/0095708 | A1 | 4/2013 | Mitose et al. | |
| 2015/0011117 | A1* | 1/2015 | Ohnuma ..... | H01R 4/185<br>439/520 |
| 2015/0140856 | A1* | 5/2015 | Sato ..... | H01R 4/70<br>439/523 |
| 2017/0005417 | A1 | 1/2017 | Aoki et al. | |

FOREIGN PATENT DOCUMENTS

| | | | |
|---|---|---|---|
| WO | 2011/122622 | A1 | 10/2011 |
| WO | 2014/154706 | A1 | 10/2014 |

* cited by examiner

CRIMP TERMINAL AND CRIMP TERMINAL MANUFACTURING METHOD

TECHNICAL FIELD

The present invention relates to a crimp terminal crimp-connected to a covered wire having an aluminum core wire and a method of manufacturing such a crimp terminal.

BACKGROUND ART

In recent years, covered electric wires having aluminum core wires have been used for wire harnesses in place of covered electric wires having copper core wires. At this time, for example, some crimp terminals such as connector terminals are made of a copper alloy or the like, and the surface thereof is tin-plated or gold-plated. When crimp terminals of this type are crimped to the end portions of the covered electric wires where the aluminum core wires are exposed, contact between dissimilar metals occurs between the aluminum core wires and the crimping barrel section of the crimp terminal. If moisture adheres to such a contact portion, there is a possibility that the aluminum core made of aluminum, which is a base metal, is corroded due to so-called dissimilar metal corrosion.

Therefore, there has been proposed a crimp terminal surrounded by a seal member around the contact portion between the barrel section and the aluminum core wire (see, for example, Patent Literature 1). According to such type of crimp terminal, moisture can be prevented from entering the contact portion of dissimilar metals, and generation of dissimilar metal corrosion as described above can be avoided.

FIG. 49 is a view showing an example of a conventional crimp terminal surrounding the contact portion between the barrel section and the aluminum core wire with a seal member.

The crimp terminal 7 shown in FIG. 49 comprises a barrel section 71 and a terminal section 72, which are made of a metal plate such as a copper alloy by sheet metal working and subjected to tin plating or gold plating on the surface, and are arranged in the axial direction D71. The barrel section 71 is a portion that is wound around and crimped on the end portion W7*a* of the covered electric wire W7 having the aluminum core wire W71, the aluminum core wire W71 being exposed. The terminal section 72 is a female terminal connected to a pin terminal (not shown) as a connection object.

The barrel section 71 has a structure in which the metal plate is bent so that the cross section that intersects with the axial direction D71 is substantially U-shaped. After the end portion W7*a* of the covered electric wire W7 is placed on the inner surface 711 of the barrel section 71, the barrel section 71 is wound around the end portion W7*a* and crimped. A part of the inner surface 711 of the barrel section 71 is a contact portion 711*a* with the aluminum core wire W71 at the end portion W7*a*.

In the contact portion 711*a*, a serration 74 is formed in which a plurality of rows of grooves extending in an intersecting direction D72 crossing the axial direction D71 in the plan view with respect to the contact portion 711*a* are arranged in the axial direction D71. When the barrel section 71 is wound around the end portion W7*a* and crimped, the edge of each groove forming the serration 74 bites into the aluminum core wire W71, so that satisfactory conduction between the covered electric wire W7 and the crimp terminal 7 can be obtained.

A seal member 73 is provided so as to surround the contact portion 711*a*. When the barrel section 71 is wound around the end portion W7*a* and crimped, the sealing member 73 seals the gaps around the contact portion 711*a* and prevents moisture from entering.

PRIOR ART DOCUMENT

Patent Literature

Patent Literature 1: JP 5940198 B

SUMMARY OF INVENTION

Technical Problem

However, with the conventional crimp terminal as shown by way of example in FIG. 49, since it is just a small size for attachment to a covered electric wire, since the installation range of the seal member is narrow, manufacturing is often accompanied by difficulties.

It is therefore an object of the present invention to provide a crimp terminal having a relaxed manufacturing difficulty while securing waterproofness against a contact portion with an aluminum core wire and to provide a method of manufacturing such a crimp terminal.

Solution to Problem

According to a first aspect of the present invention, there is provided a crimp terminal in which a barrel section to be wound around and crimped to an end portion of a covered electric wire having an aluminum core wire at which the aluminum core wire is exposed, and a terminal section to be connected to a connection object are arranged in a predetermined axial direction, wherein the barrel section includes: a bottom plate section extending in the axial direction, on which the end portion of the covered electric wire is to be placed; and an inner barrel piece and an outer barrel piece extending from the bottom plate portion on both sides in a crossing direction intersecting the axial direction in plan view with respect to the bottom plate portion, the barrel section being configured to wound around the end portion with the inner barrel piece inside while crimping, wherein a plurality of concave sections is dispersedly provided on an inner surface of the barrel section, wherein the crimp terminal includes a sealing member formed from an adhesive gel sheet and affixed across a first region that longitudinally traverses the outer barrel piece in the axial direction, a second region which traverses the inner surface in the crossing direction at a position closer to the terminal section than the aluminum core wire, and a third region that traverses the inner surface in the crossing direction so as to intersect a covered portion of the end portion, and the sealing member seals, after crimping, between the inner barrel piece and the outer barrel piece, an opening of the barrel section which is to be cylindrical on a side of the terminal section, and between the covered portion and the barrel section, and wherein the seal member is affixed in a state of being divided in a halfway of a path from the second region to the third region via the first region.

In the crimp terminal of the present invention, by the crimping, the edges of the concave sections provided on the inner surface of the barrel section bites into the aluminum core wire, whereby good conduction between the covered electric wire and the crimp terminal can be obtained. In the crimp terminal of the present invention, the crimp terminal is formed of an adhesive gel sheet, and after crimping, a seal member for sealing between the inner barrel piece and the outer barrel piece, an opening of the barrel section which is to be cylindrical on a side of the terminal section, and between the covered portion and the barrel section is affixed to the inner surface of the barrel section. By this sealing member, waterproofness against the above-mentioned contact portion between the aluminum core wire and the inner surface of the barrel section is secured. Here, in the crimp terminal of the present invention, the seal member is attached in a state of being divided in the middle of a path from the second region to the third region via the first region. That is, since a seal member that tends to have a complicated shape by tracing the above-described path to obtain waterproofness is attached to each of the divided individual pieces, for example, as compared with sticking a non-divided state seal member or the like, the sticking work becomes easy. In this way, according to the crimp terminal of the present invention, it is possible to alleviate difficulties in manufacturing while securing waterproofness against a contact portion with the aluminum core wire.

Further, in the crimp terminal of the present invention, since the seal member is a sheet of an adhesive gel whose thickness is determined in advance, the amount of the gel for sealing the above-mentioned portion without excess or deficiency can be adjusted easily and accurately depending on the area of the seal member at the time of manufacture. According to the crimp terminal of the present invention, also in this sense, for example, as compared with coating a gel-like resin material for sealing or the like, it is possible to relieve difficulties in manufacturing while ensuring waterproofness at a high level.

Preferably, there is provided the crimp terminal of the present invention, wherein the seal member is affixed in a state that the seal member is divided so as to traverse the path in the axial direction.

Although the divided seal members are extended and connected by crimping, the elongation rate due to crimping is larger in the cross direction than in the above-described axial direction. In the preferred crimp terminal described above, since the seal member is divided across the above-mentioned path in the axial direction, at the time of crimping, the divided portions are connected due to the elongation in the cross direction where the elongation rate is large. Therefore, according to this preferable crimp terminal, higher waterproofness can be secured.

Preferably, there is provided the crimp terminal of the present invention, wherein the seal member includes: a first seal portion extending in a band shape in the axial direction in the first region, a second seal portion extending in a band shape in the crossing direction in the second region; and a third seal portion extending in a band shape in the crossing direction in the third region, and wherein at least one of the second seal portion and the third seal portion is affixed in a state of being divided from the first seal portion.

According to this preferred crimp terminal, at least one of the second seal portion and the third seal portion is affixed in a very simple shape as a band shape. Therefore, according to this preferable crimp terminal, it is possible to further alleviate the difficulty in manufacturing.

Further, in this preferred crimp terminal, it is further preferable that both the second seal portion and the third seal portion are affixed in a state where the second seal portion and the third seal portion are separated from the first seal portion.

According to this preferable crimp terminal, all of the first seal portion, the second seal portion, and the third seal portion are affixed in a very simple shape as a band shape. Therefore, according to this preferable crimp terminal, it is possible to further alleviate the difficulty in manufacturing.

Further, in the crimp terminal of the present invention, a groove section is formed on the inner surface of the barrel section so as to overlap with the seal member in the first region, the second region, and the third region, and the plurality of concave sections is preferably provided avoiding the groove section.

According to this preferable crimp terminal, the movement of the seal member due to the pressure applied at the time of crimping is suppressed by the groove section overlapping with the seal member. Therefore, according to this preferred crimp terminal, it is possible to alleviate difficulties in manufacturing while securing waterproofness at a higher level.

According to a second aspect of the present invention, there is provided a terminal manufacturing method for manufacturing a crimp terminal in which a barrel section to be wound around and crimped to an end portion of a covered electric wire having an aluminum core wire to which the aluminum core wire is exposed, and a terminal section to be connected to a connection object are arranged in a predetermined axial direction, the method comprising:

a sheet metal processing step in which the barrel section is made from a sheet metal with the terminal section, the barrel section including: a bottom plate section extending in the axial direction, on which the end portion of the covered electric wire is to be placed; and an inner barrel piece and an outer barrel piece extending from the bottom plate portion on both sides in a crossing direction intersecting the axial direction in plan view with respect to the bottom plate portion, and wound around the end portion with the inner barrel piece inside while crimping, and a plurality of concave sections is dispersedly provided on an inner surface of the barrel section, and a sealing member affixing step in which a sealing member configured to seal, after crimping, between the inner barrel piece and the outer barrel piece, an opening of the barrel section which is to be cylindrical on a side of the terminal section, and between the covered portion and the barrel section is formed from an adhesive gel sheet, and the sealing member is affixed across a first region that longitudinally traverses the outer barrel piece in the axial direction, a second region which traverses the inner surface in the crossing direction at a position closer to the terminal section than the aluminum core wire, and a third region that traverses the inner surface in the crossing direction so as to intersect a covered portion of the end portion, wherein the sealing member affixing step is a step in which the sealing member is affixed in a state of being divided in a halfway of a path from the second region to the third region via the first region.

According to the terminal manufacturing method of the present invention, since the sealing member is affixed in a divided state, difficulty in manufacturing can be alleviated while securing waterproofness against a contact portion with the aluminum core wire. Further, according to the terminal manufacturing method of the present invention, since the seal member is formed with the adhesive gel sheet, difficulty in manufacturing can be alleviated while ensuring waterproofness at a high level.

Although only the basic form of the terminal manufacturing method of the present invention has been described here, it goes without saying that various preferred forms of the above-described crimp terminal of the present invention can be applied as a preferable form to the terminal manufacturing method of the present invention.

Effect of the Invention

According to the present invention, it is possible to obtain a crimp terminal having a relaxed manufacturing difficulty while securing waterproofness against a contact portion with an aluminum core wire, and a terminal manufacturing method for manufacturing such a crimp terminal.

DESCRIPTION OF EMBODIMENTS

Hereinafter, various embodiments of the present invention will be described. First, the first embodiment will be explained with appropriate modifications.

Figure 1:
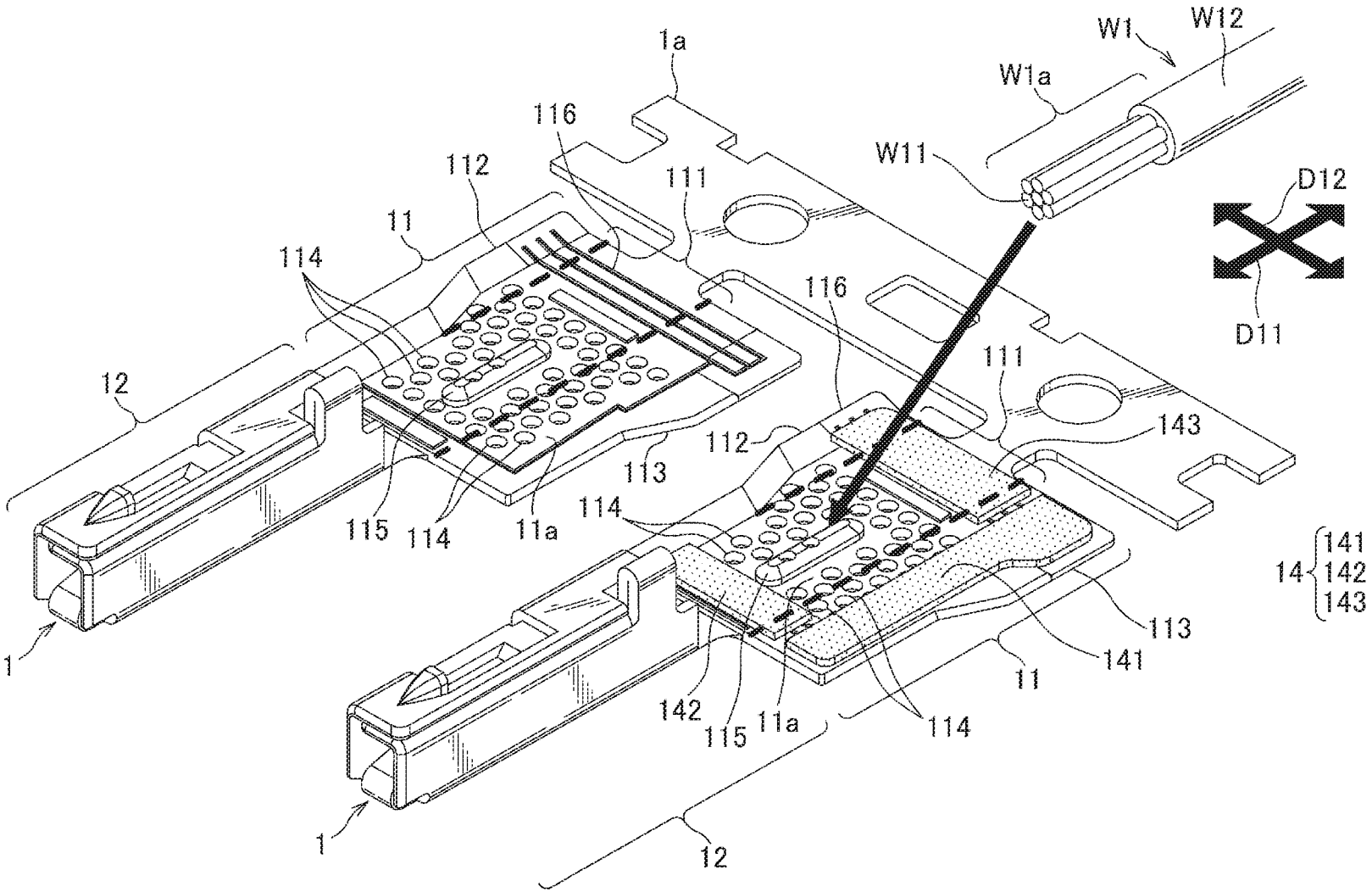
FIG. 1 is an explanatory view for explaining a crimp terminal according to a first embodiment of the present invention.

FIG. 1 is an explanatory view for explaining a crimp terminal according to a first embodiment of the present invention.

A crimp terminal 1 according to the present embodiment is crimped to an end portion W1*a* of a covered electric wire W1 exposing an aluminum core wire W11. The crimp terminal 1 includes a barrel section 11, a terminal section 12, and a seal member 14. Although two crimp terminals 1 are shown in FIG. 1, one crimp terminal 1 is shown with the seal member 14 removed so that an inner surface shape of the barrel section 11 can be visually observed.

The barrel section 11 and the terminal section 12 are made from a metal plate such as a copper alloy by punching and sheet metal working, and its surface is subjected to tin plating or gold plating. The barrel section 11 and the terminal section 12 are arranged in a predetermined axial direction D11. Here, in the present embodiment, the barrel section 11 and the terminal section 12 are collectively formed in a state in which a plurality of crimp terminals 1 are connected by a strip-like connecting piece 1*a*. The barrel section 11 is a plate-like portion wound and wound around the end portion W1*a* of the covered electric wire W1 so as to wrap around the aluminum core wire W11 and the covered portion W12 in a circumferential direction. The terminal section 12 is a square tubular female terminal connected to a pin terminal (not shown) as a connection object.

The barrel section 11 has a bottom plate section 111, an inner barrel piece 112, and an outer barrel piece 113. The bottom plate section 111 extends in the above-mentioned axial direction D11. The inner barrel piece 112 and the outer barrel piece 113 extend from the bottom plate section 111 on both sides in a crossing direction D12 intersecting the axial direction D11 in plan view with respect to the bottom plate section 111. When crimping the end portion W1*a* of the covered electric wire W1, the barrel section 11 is wound around the end portion W1*a* with the inner barrel piece 112 inside and the outer barrel piece 113 outside as described later.

Here, a plurality of concave sections 114 is dispersedly provided on an inner surface 11*a* of the barrel section 11. Each concave section 114 is formed in a circular shape in plan view with respect to the inner surface 11*a* of the barrel section 11. Further, a convex section 115 is formed on the bottom plate section 111 of the barrel section 11 by press working from an outer surface side at a position where the aluminum core wire W11 at the end portion W1*a* of the covered electric wire W1 is placed. A part of the plurality of concave sections 114 is also formed on the convex section 115.

A seal member 14 formed of an adhesive gel sheet is affixed to the inner surface 11*a* of the barrel section 11 so as to surround the plurality of concave sections 114 from three sides in a plan view. The seal member 14 is affixed as follows. Incidentally, examples of the adhesive gel sheet include, for example, those using acrylic adhesives, but the present invention is not limited thereto.

Figure 2:
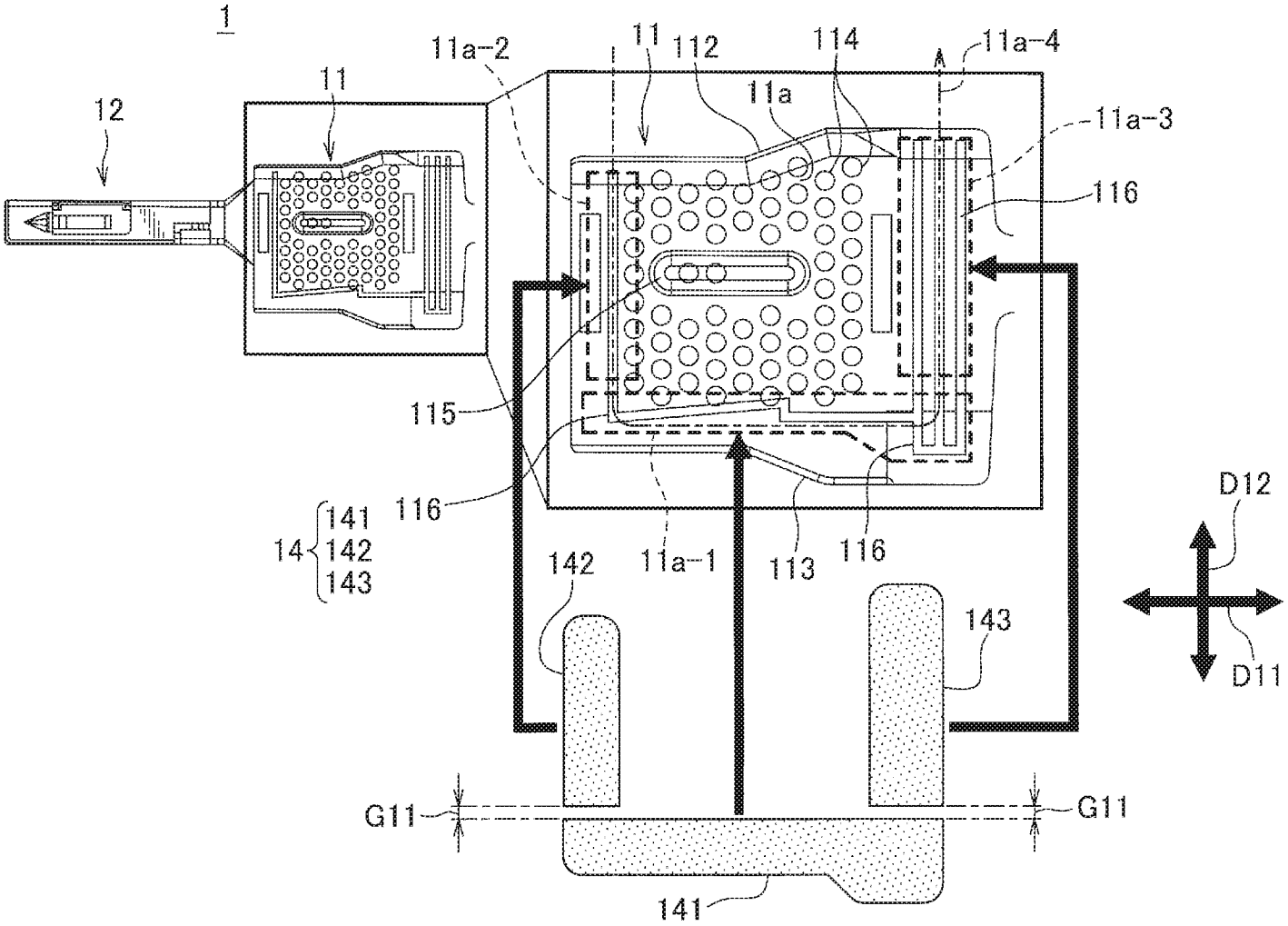
FIG. 2 is a schematic view showing how the seal member shown in FIG. 1 is affixed to an inner surface of a barrel section.

FIG. 2 is a schematic view showing how the seal member shown in FIG. 1 is affixed to the inner surface of the barrel section.

The sealing member 14 is formed of an adhesive gel sheet and is arranged over three regions of the first region 11*a*-1, the second region 11*a*-2, and the third region 11*a*-3 on the inner surface 11*a* of the barrel section 11. The first region 11*a*-1 is a region that longitudinally traverses the outer barrel piece 113 in the axial direction D11. The second region 11*a*-2 is an area that traverses the inner surface 11*a* in the crossing direction D12 closer to the terminal section 12 than the aluminum core wire W11 when the end portion W1*a* is placed. The third region 11*a*-3 is an area traversing the inner surface 11*a* in the crossing direction D12 so as to intersect the covered portion W12 of the end portion W1*a*.

As shown in FIGS. 1 and 2, in the present embodiment, the seal member 14 is composed of three portions, a first seal portion 141, a second seal portion 142, and a third seal portion 143. The first seal portion 141 extends in a band shape in the axial direction D11 in the first region 11*a*-1. The second seal portion 142 extends in a band shape in the crossing direction D12 in the second region 11*a*-2. The third seal portion 143 extends in a band shape in the cross direction D12 in the third region 11*a*-3.

In the present embodiment, the seal member 14 is attached in a state of being divided in a halfway of a path 11*a*-4 extending from the second region 11*a*-2 through the first region 11*a*-1 to the third region 11*a*-3. Specifically, the seal member 14 is attached in a state where both the second seal portion 142 and the third seal portion 143 are separated from the first seal portion 141. Both the second seal portion 142 and the third seal portion 143 are attached in a state where the second seal portion 142 and the third seal portion 143 are separated from the first seal portion 141 across the path 11*a*-4 in the axial direction D11. A slight gap G11 opens between the second seal portion 142 and the first seal portion 141, and between the third seal portion 143 and the first seal portion 141.

Further, in the present embodiment, in the inner surface 11*a* of the barrel section 11, a groove section 116 is formed in the first region 11*a*-1, the second region 11*a*-2, and the third region 11*a*-3 so as to overlap with the seal member 14. In the first region 11*a*-1, one groove extends in the axial direction D11 while bending in a sawtooth shape in the middle. One line extends linearly in the crossing direction D12 in the second area 11*a*-2, three lines extend linearly in the crossing direction D12 in the third area 11*a*-3, and they are joined together on a side of the first area 11*a*-1. Then, the plurality of concave sections 114 is provided so as to avoid the groove section 116.

The first seal portion 141, the second seal portion 142, and the third seal portion 143 are affixed so that they respectively overlap the first region 11*a*-1, the second region 11*a*-2, and the third region 11*a*-3 of the groove section 116. Here, the plurality of concave sections 114 is provided so as to partially overlap with the seal member 14. Specifically, as shown in FIG. 2, the concave sections 114 on an edge side of the outermost barrel piece 113 partially overlap with the first region 11*a*-1, the concave sections 114 closest to the terminal section 12 are located at the second region 11*a*-2 so as to partially overlap with each other. As a result, the first seal portion 141 affixed to the first region 11*a*-1 and the second seal portion 142 affixed to the second region 11*a*-2 partially overlap with a part of the concave sections 114.

The crimp terminal 1 described above is manufactured by the following terminal manufacturing method.

In this terminal manufacturing method, firstly, a sheet metal working step of forming a structure before attachment of the seal member 14 is performed. In the sheet metal working step, the barrel section 11 is formed from a metal plate together with the terminal section 12. As described above, in the present embodiment, in the sheet metal working process, the barrel section 11 and the terminal section 12 are collectively formed in a state in which a plurality of crimp terminals 1 are connected by the strip-like connecting piece 1*a*. In this sheet metal working step, formation of a plurality of concave sections 114, formation of convex sections 115, and formation of groove sections 116 on the inner surface 11*a* of the barrel section 11 are also performed.

Subsequently, the seal member 14 is formed with an adhesive gel sheet, and the seal member affixing step of affixing the seal member 14 over the first area 11*a*-1, the second area 11*a*-2, and the third area 11*a*-3 is performed. In this the seal member affixing step, the seal member 14 is affixed in a state where the seal member 14 is divided in a halfway of the path 11*a*-4 from the second region 11*a*-2 to the third region 11*a*-3 via the first region 11*a*-1. That is, the first seal portion 141, the second seal portion 142, and the third seal portion 143 are individually affixed to the inner surface 11*a* of the barrel section 11.

In addition, in the sealing member affixing step, the first seal portion 141, the second seal portion 142, and the third seal portion 143 are punched out from the adhesive gel sheet and affixed to the inner surface 11*a* of the barrel section 11. By pushing the adhesive gel sheet toward each of the affixing points on the inner surface 11*a* of the barrel section 11 while punching out the adhesive gel sheet with the die punching cutter of each seal portion, punching out and affixing are performed substantially at the same time.

The crimp terminal 1 manufactured in this manner is crimped to the end portion W1*a* of the covered electric wire W1 as follows.

Figure 3:
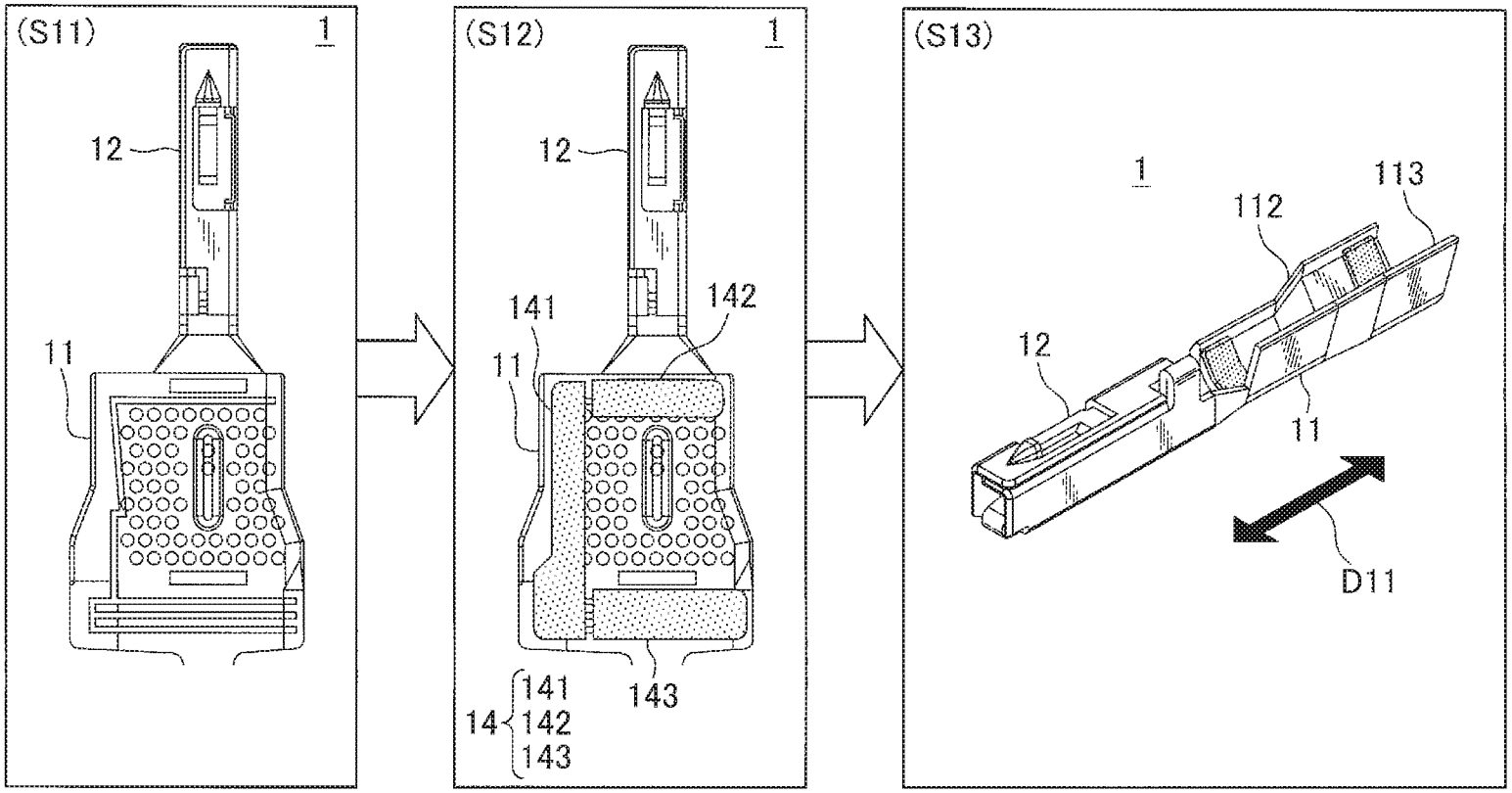
FIG. 3 is a view showing a procedure until preparations are made for crimping the crimp terminal shown in FIGS. 1 and 2 to an end portion of a covered electric wire.
Figure 4:
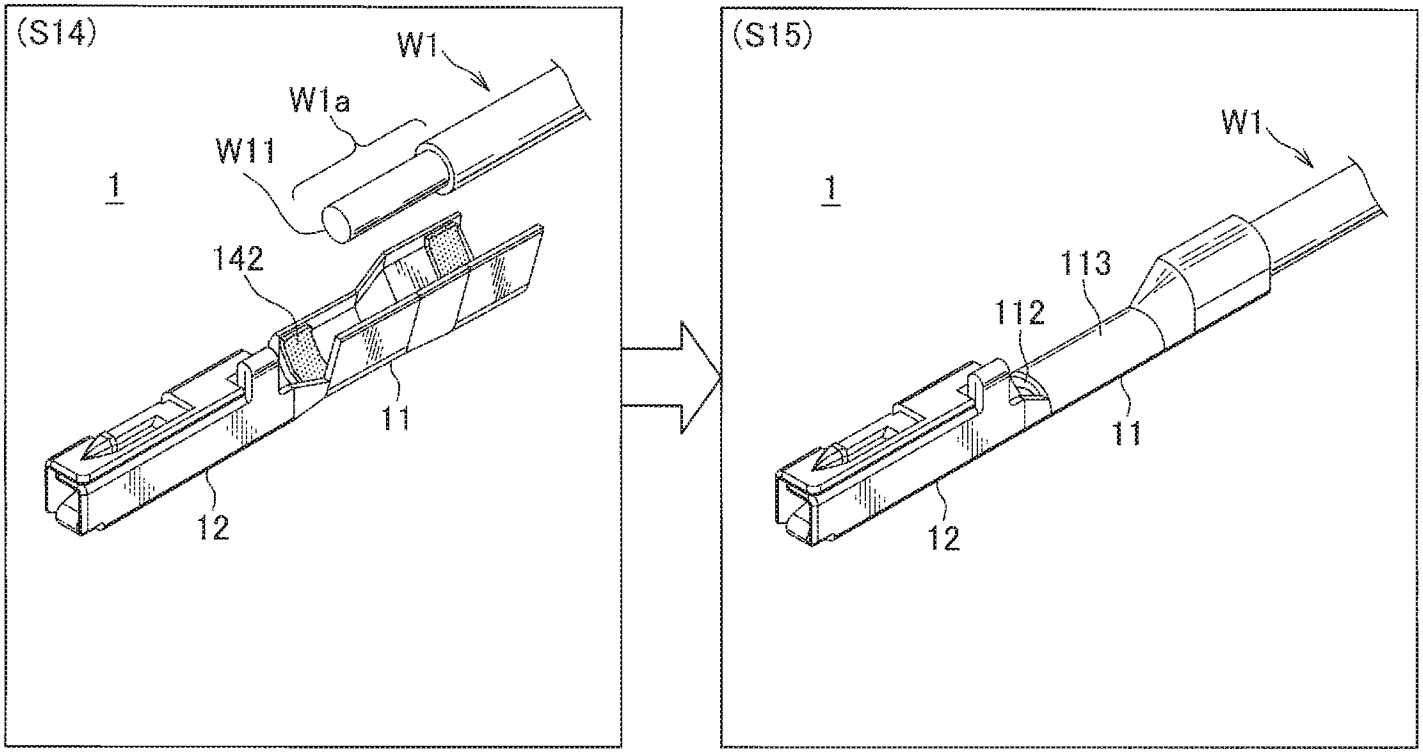
FIG. 4 is a view showing a procedure until the crimp terminal is crimped to the end portion of the covered electric wire following the procedure shown in FIG. 3.

FIG. 3 is a view showing a procedure until preparations are made for crimping the crimp terminal shown in FIGS. 1 and 2 to an end portion of a covered electric wire, and FIG. 4 is a view showing a procedure until the crimp terminal is crimped to the end portion of the covered electric wire following the procedure shown in FIG. 3.

FIG. 3 shows the sheet metal working step (S11) and also shows the sealing member affixing step (S12) in the terminal manufacturing method described above. In the sheet metal working step (S11), the barrel section 11 and the terminal section 12 are formed, and in the sealing member affixing step (S12), the first seal portion 141, the second seal portion 142 and the third seal portion 143 constituting the seal member 14 are affixed.

When crimping the end portion W1*a* of the covered electric wire W1, firstly, the crimp terminal 1 to be crimped is separated from the connecting piece 1*a* shown in FIG. 1. Then, for the barrel section 11, bending deformation is performed as preparation for placing the end portion W1*a* of the covered electric wire W1 (S13). This bending deformation is performed such that the inner barrel piece 112 and the outer barrel piece 113 are brought close to each other so that the cross section intersecting with the axial direction D11 is substantially U-shaped.

Subsequently, the end portion W1*a* of the covered electric wire W1 is placed on the barrel section 11 after the bending deformation (S14). At this time, the end portion W1*a* is placed so that a tip of the aluminum core wire W11 does not overlap with the second seal portion 142. Incidentally, overlapping of the tip of the aluminum core wire W11 with the second seal portion 142 is permitted to some extent. Subsequently, the barrel section 11 is wound around the end part W1*a* so that the outer barrel piece 113 is overlapped with the inner barrel piece 112 facing inward (S15).

By such crimping, the seal member 14 seals the various portions of the crimp terminal 1 as follows.

Figure 5:
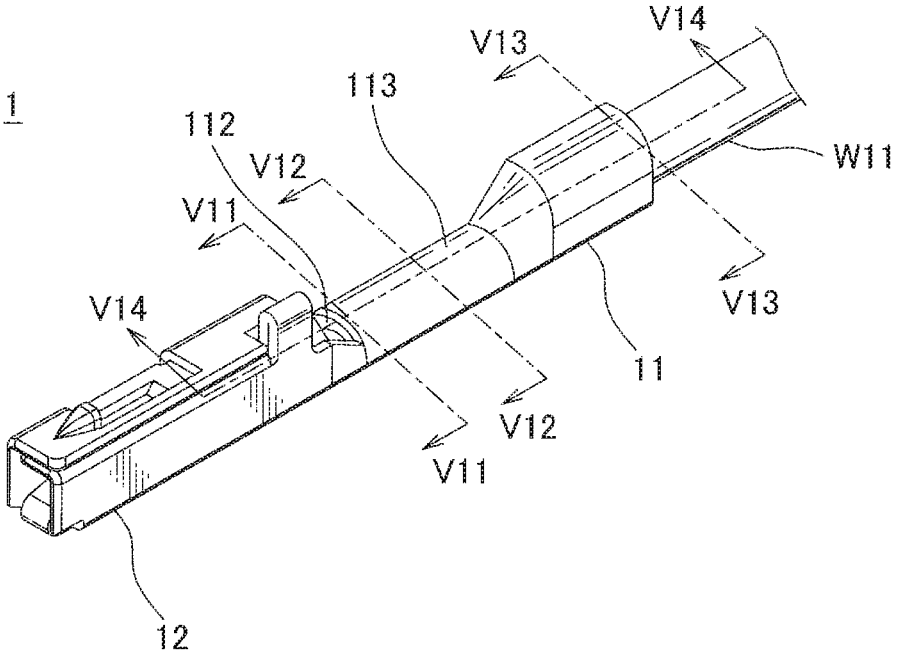
FIG. 5 is a view showing the crimp terminal after crimping also shown in FIG. 4.
Figure 6:
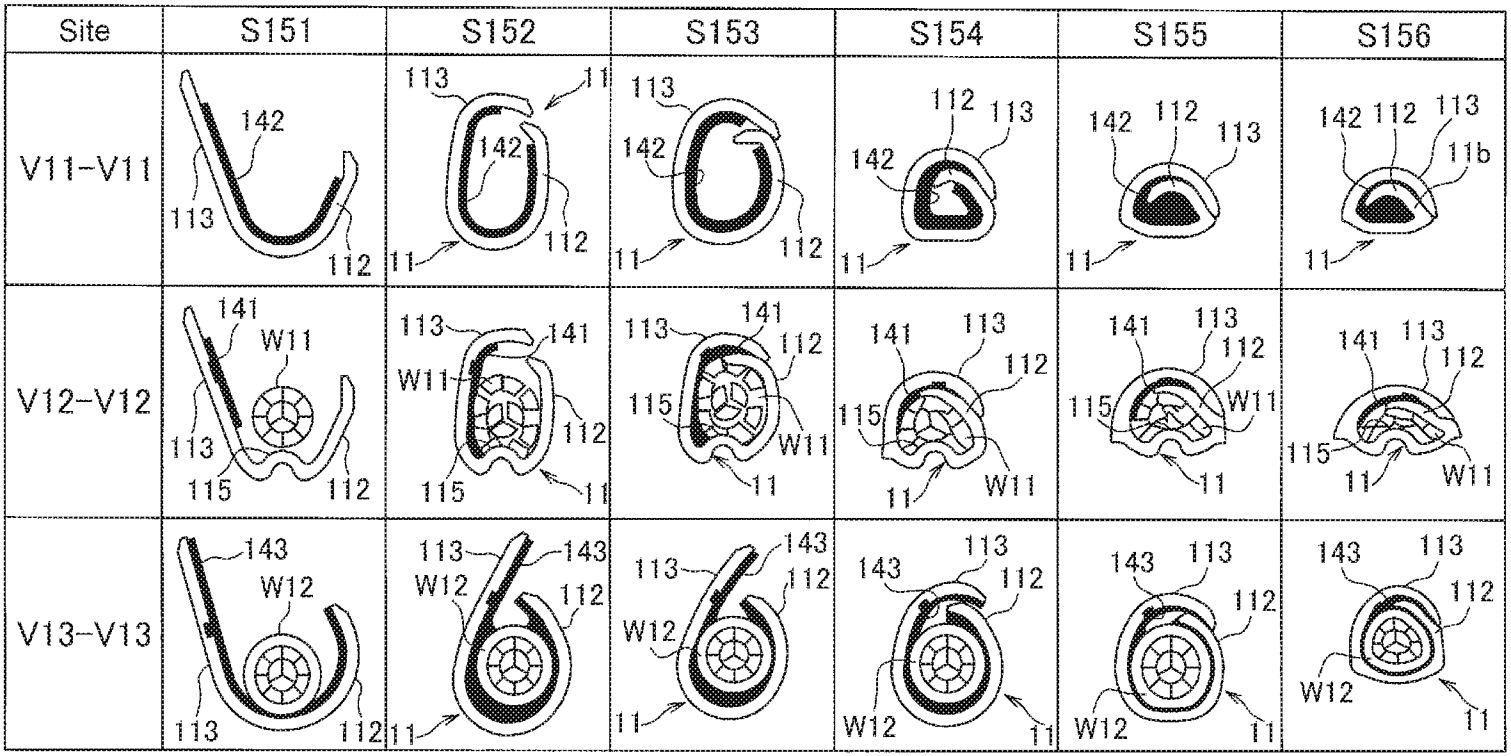
FIG. 6 is a view showing a change during a crimping operation in a cross section taken along line V11-V11, a cross section taken along line V12-V12, and a cross section taken along line V13-V13 in FIG. 5.

FIG. 5 is a view showing the crimp terminal after crimping also shown in FIG. 4, and FIG. 6 is a view showing a change during a crimping operation in a cross section taken along line V11-V11, a cross section taken along line V12-V12, and a cross section taken along line V13-V13 in FIG. 5.

In the first step (S151) of the crimping operation, bending of the inner barrel piece 112 and the outer barrel piece 113 is started so as to wind around the aluminum core wire W11 on the convex section 115 and the covered portion W12 in the vicinity thereof. At this time, the first seal portion 141 is in contact with the aluminum core wire W11, the third seal portion 143 is in contact with the covered portion W12, and almost none of the second seal portion 142 contacts. In the second step (S152) and the third step (S153) in which the winding is slightly advanced, the barrel section 11 has a tubular shape. Then, the first seal portion 141 is sandwiched between the inner barrel piece 112 and the outer barrel piece 113, and the third seal part 143 is extended in a state sandwiched between the covering portion W12 and the barrel section 11.

In the fourth step (S154), the fifth step (S155), and the sixth step (S156) where pressure is applied to the aluminum core wire W11 etc., the edges of the plurality of concave sections 114 dig into the aluminum core wire W11. At this time, the strands of the aluminum core wire W11 are spread by the convex section 115 located under the aluminum core wire W11, and the number of contacts between the barrel section 11 and these strands increases. At the same time, the extension of the seal member 14 also proceeds.

Here, as described above, in the present embodiment, a slight gap G11 opens between the second seal portion 142 and the first seal portion 141, and between the third seal portion 143 and the first seal portion 141. This gap G11 is closed by extension of the seal member 14 during crimping.

Figure 7:
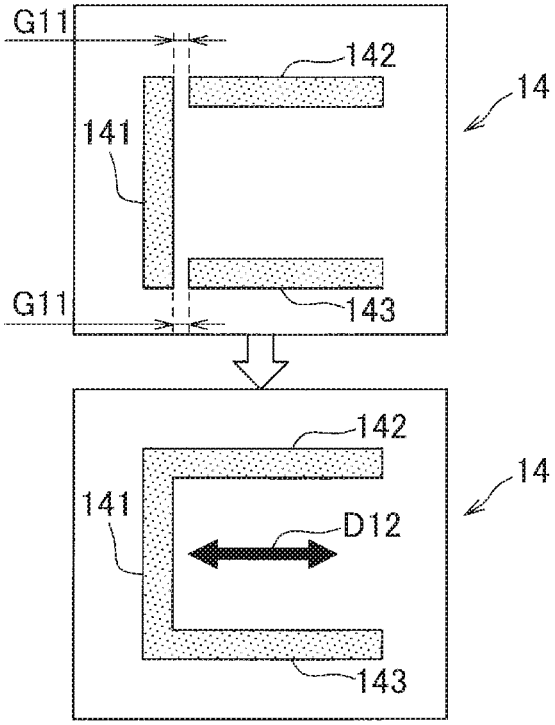
FIG. 7 is a schematic view showing how the gap between the second seal portion and the first seal portion, and between the third seal portion and the first seal portion shown in FIG. 2 is closed by extension of the seal member at the time of crimping.

FIG. 7 is a schematic view showing how the gap between the second seal portion and the first seal portion, and between the third seal portion and the first seal portion shown in FIG. 2 is closed by extension of the seal member at the time of crimping.

As shown in FIG. 7, at the time of crimping, the second seal portion 142 and the third seal portion 143 are extended in the crossing direction D12 which coincides with a length direction thereof. Due to this extension, the second seal portion 142 and the third seal portion 143 are connected to the first seal portion 141, and the gap G11 is closed.

Next, in the sixth step (S156), a space between the inner barrel piece 112 and the outer barrel piece 113, the opening lib of the tubular barrel section 11 on a side of the terminal section 12, and a space between the covered portion W12 and the barrel section 11 are sealed by the extended sealing member 14.

Figure 8:
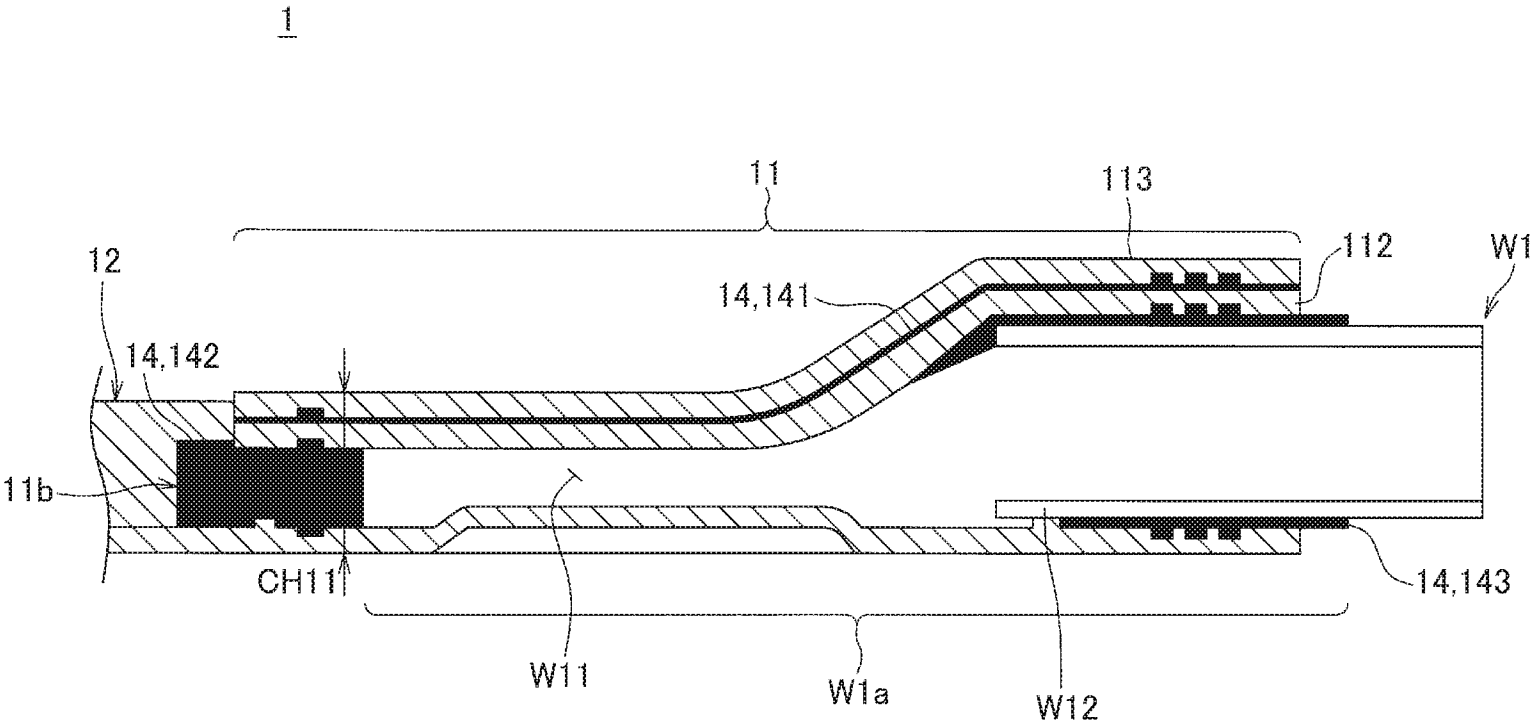
FIG. 8 is a sectional view taken along the line V14-V14 in FIG. 5, showing a state in which the seal member seals each portion of the barrel section of the crimp terminal after crimping.

FIG. 8 is a sectional view taken along the line V14-V14 in FIG. 5, showing a state in which the seal member seals each portion of the barrel section of the crimp terminal after crimping. As shown in FIG. 8, the space between the inner barrel piece 112 and the outer barrel piece 113 is sealed by the first seal portion 141 and the opening 11*b* of the barrel part 11 on the side of the terminal part 12 is sealed by the second seal portion 142. Further, a space between the covered portion W12 and the barrel section 11 is sealed by the third seal portion 143.

At this time, in the present embodiment, a dimension in a vertical direction in FIG. 8 (hereinafter referred to as a crimp height CH11) where pressure is mainly applied in the barrel section 11 after crimping is set to the following dimension. That is, the barrel section 11 having a cylindrical shape is crushed to such an extent that a part of the seal member 14 formed of an adhesive gel sheet having a certain thickness and width protrudes from the opening 11*b* of the barrel section 11. By setting the crimp height CH11 to such a size, the opening 11*b* of the barrel section 11 is sealed at a high level. A part of the seal member 14 also protrudes from the space between the covering portion W12 and the barrel section 11 even on an extending side of the covered electric wire W1 in the barrel section 11 to seal this part at a high level. In other words, the dimensions such as the widths of the first seal portion 141, the second seal portion 142, and the third seal portion 143 constituting the seal member 14 have dimensions necessary and sufficient for such sealing after crimping.

Further, by forming each portion of the seal member 14 so as to project from the opening 11*b* of the barrel section 11 or the extending side of the covered electric wire W1, it is possible to visually check that these portions are surely sealed with the seal member 14 after crimping.

Figure 9:
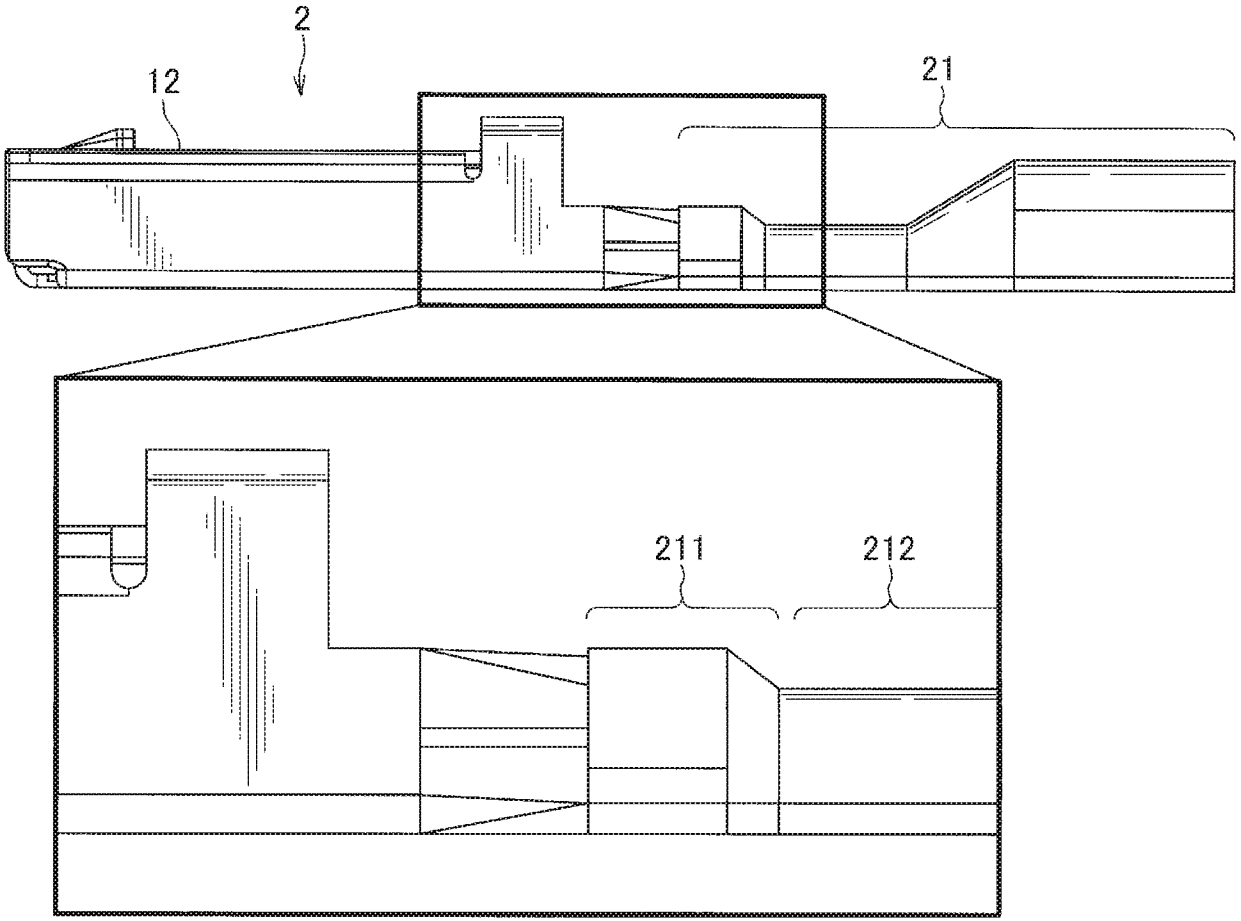
FIG. 9 is a view showing a crimp terminal of a first modification to the crimp terminal of the first embodiment shown in FIGS. 1 to 8.
Figure 10:
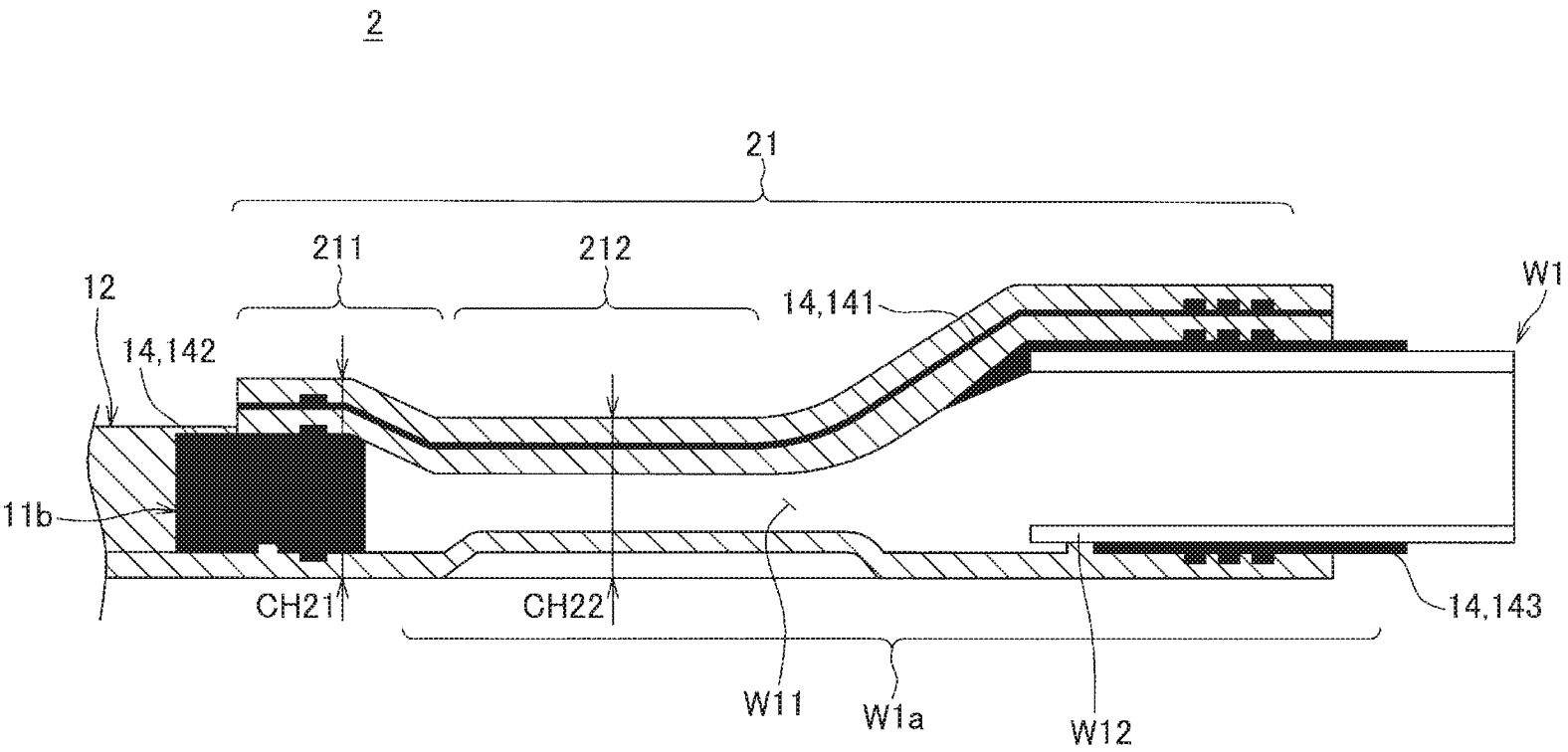
FIG. 10 is a view showing a cross section similar to FIG. 8 of the crimp terminal of the first modification shown in FIG. 9.

FIG. 9 is a view showing a crimp terminal of a first modification to the crimp terminal of the first embodiment shown in FIGS. 1 to 8. FIG. 10 is a view showing a cross section similar to FIG. 8 of the crimp terminal of the first modification shown in FIG. 9. Incidentally, in FIGS. 9 and 10, the same reference numerals as those in FIGS. 1 to 8 denote the same constituent elements as those shown in FIGS. 1 to 8, and in the following description, the duplicate explanation of the same constitute elements will be omitted.

In the crimp terminal 2 of the first modification, a crimp height CH21 of the terminal section 12 side (hereinafter referred to as a front end portion 211) of the barrel section 21 after crimping is higher than a crimp height CH22 of the crimping portion 212 of the aluminum core wire W11. Even in this case, the crimp height CH21 of the front end portion 211 has such a size that a part of the seal member 14 projects from the opening 11*b* of the barrel section 11 and the opening 11*b* is sealed at a high level. The dimensions such as the width of each portion of the first seal portion 141, the second seal portion 142, and the third seal portion 143 forming the seal member 14 are formed to have dimensions necessary and sufficient for such sealing after crimping. By relatively reducing the crimp height CH22 of the crimp portion 212 as described above, the crimping of the aluminum core wire W11 is strengthened, and the contact reliability with the crimp terminal 2 is improved.

In the crimp terminal 1 of the present embodiment described above, the edges of the concave sections 114 provided on the inner surface 11*a* of the barrel section 11 bites into the aluminum core wire W1*a* by crimping so that good conduction between the covered electric wire W1 and the crimp terminal 1 is obtained. Then, the seal member 14 formed of an adhesive gel sheet is affixed to the inner surface 11*a* of the barrel section 11. After crimping, the seal member 14 seals the space between the inner barrel piece 112 and the outer barrel piece 113, the opening 11*b* of the cylindrical barrel section 11 at the side of the terminal section 12, and the space between the covered portion W12 and the barrel section 11. This seal member 14 ensures waterproofness against the contact portion which makes contact between the aluminum core wire W1*a* and the inner surface 11*a* of the barrel section 11 as dissimilar metal contact. Here, in the crimp terminal 1 of the present embodiment, the seal member 14 is affixed in a divided state in a halfway of the path 11*a*-4 from the second region 11*a*-2 to the third region 11*a*-3 via the first region 11*a*-1. That is, in order to obtain waterproofness, a seal member 14 tending to have a complicated shape by tracing the path 11*a*-4 as described above is affixed with each divided piece.

Figure 11:
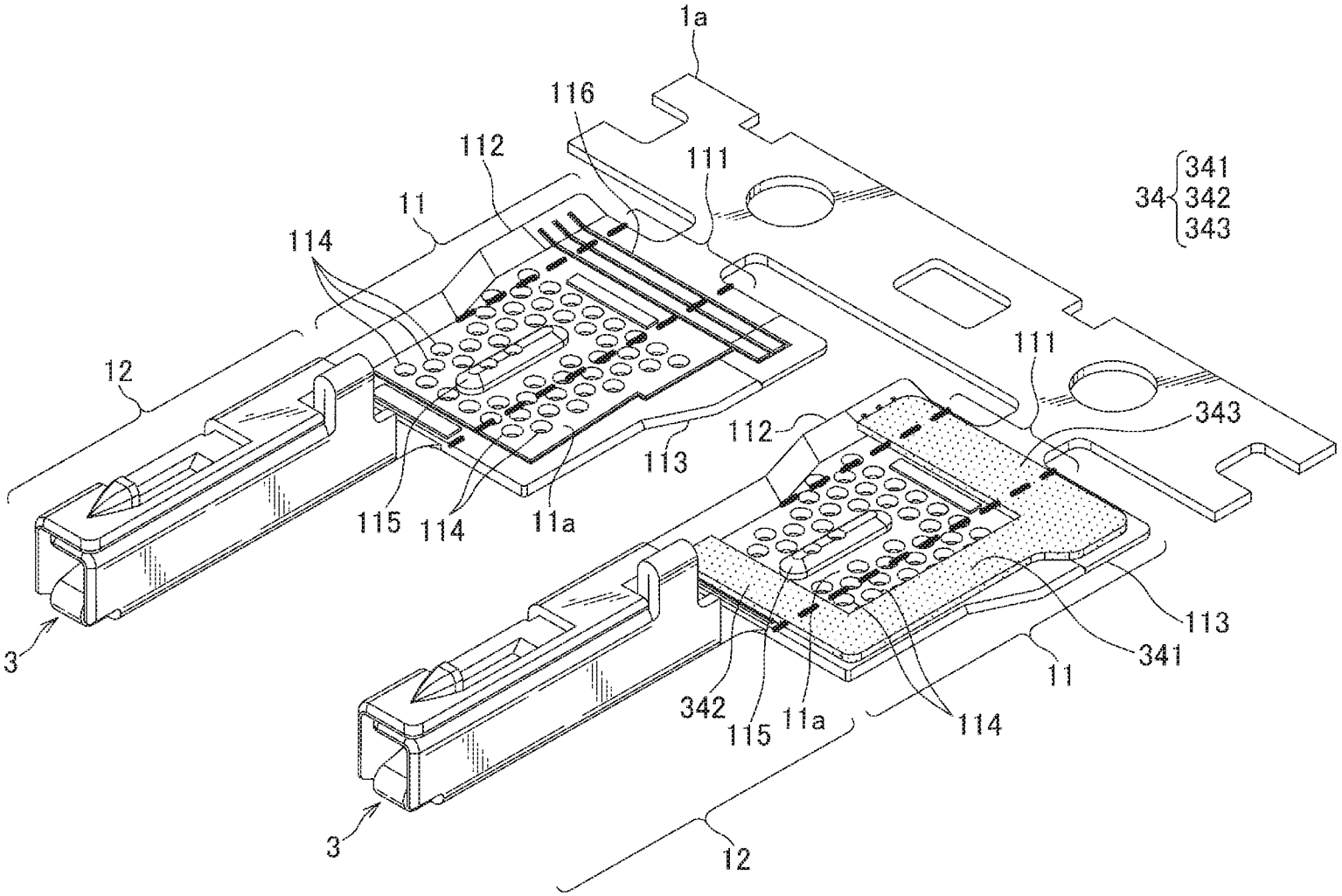
FIG. 11 is an explanatory view for explaining a crimp terminal according to a second modification to the crimp terminal of the first embodiment shown in FIGS. 1 to 8.
Figure 12:
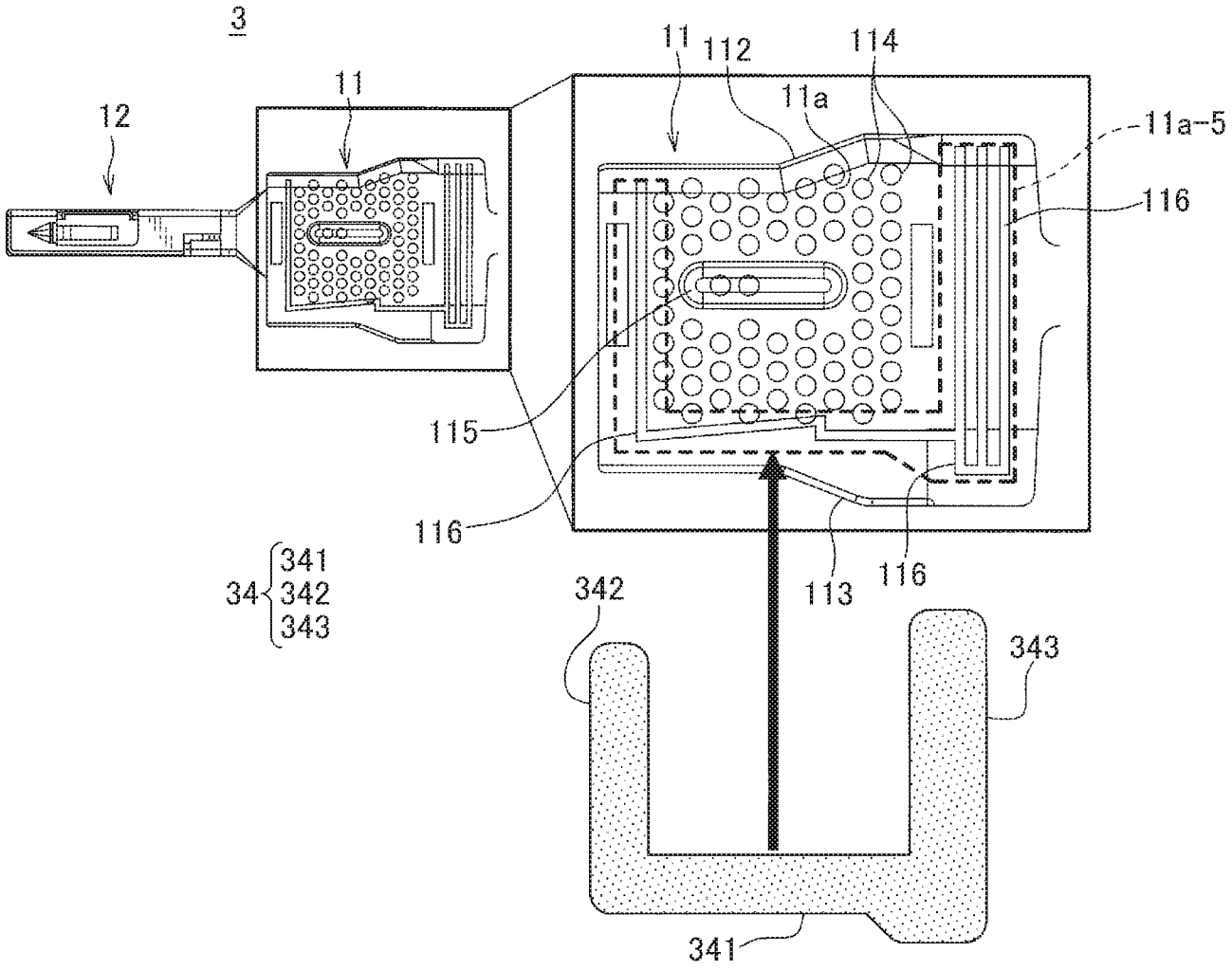
FIG. 12 is a schematic view showing how the seal member shown in FIG. 11 is affixed to an inner surface of the barrel section.

FIG. 11 is an explanatory view for explaining a crimp terminal according to a second modification to the crimp terminal of the first embodiment shown in FIGS. 1 to 8. FIG. 12 is a schematic view showing how the seal member shown in FIG. 11 is affixed to an inner surface of the barrel section. Incidentally, in FIGS. 11 and 12 also, the same reference numerals as those in FIGS. 1 to 8 denote the same constituent elements as those shown in FIGS. 1 to 8, and a duplicate explanation of the same constituent elements will be omitted. Also in FIG. 11, two crimp terminals 3 are shown, but one crimp terminal 3 is shown with the seal member 34 removed so that the inner surface shape of the barrel section 11 can be seen.

In the crimp terminal 3 of the second modification, the seal member 34 is not divided. The second seal portion 342 and the third seal portion 343 extend from the first seal portion 341 into two arms. They are connected integrally and formed in a C-shape in a plan view. This sealing member 34 is affixed to a groove section 116 on the inner surface 11*a* of the barrel section 11 and to a C-shaped region 11*a*-5 in a plan view overlapping with a part of the plurality of concave sections 114. When crimping, the first seal portion 341 seals between the inner barrel piece 112 and the outer barrel piece 113, the second seal portion 342 seals the opening of the tubular barrel section 11 at the side of the terminal section 12, and the third seal portion 343 seals between the covered portion W12 and the barrel section 11.

In the crimp terminal 1 of the above-described first embodiment, the operation of the seal member 14 to be affixed to each of the three individual pieces is easy compared with this second modification. In this way, according to the crimp terminal 1 of the present embodiment, it is possible to alleviate difficulties in manufacturing while securing waterproofness against a contact portion with the aluminum core wire W1*a*.

In addition, in the crimp terminal 1 of the present embodiment, since the seal member 14 is a sheet of an adhesive gel whose thickness has been determined in advance, the amount of the gel for sealing the above-mentioned portion without excess or deficiency depending on the area of the seal member 14 can be easily and accurately adjusted at the time of production. According to the crimp terminal 1 of the present embodiment, also in this sense, as compared with coating a gel-like resin material for sealing or the like, it is possible to alleviate difficulties in manufacturing while securing waterproofness at a high level.

Here, in the crimp terminal 1 of the present embodiment, the divided seal member 14 is extended and connected by crimping as described above with reference to FIG. 7, but the elongation rate by crimping is larger in the crossing direction D12 than in the axial direction D11. In the crimp terminal 1 of this embodiment, since the seal member 14 is divided across the path 11*a*-4 in the axial direction D11, at the time of crimping, the split portions are connected by the extension in the crossing direction D12 having the large elongation rate. Therefore, higher waterproofness can be secured.

In addition, in the crimp terminal 1 of the present embodiment, the seal member 14 is attached in a very simple shape in which all of the first seal portion 141, the second seal portion 142, and the third seal portion 143 are in the form of a belt. Thus, according to the crimp terminal 1 of the present embodiment, it is possible to further alleviate difficulties in manufacturing.

Further, in the crimp terminal 1 of the present embodiment, a groove section 116 is formed on the inner surface 11*a* of the barrel section 11 so as to overlap the seal member 14, and the plurality of concave sections 114 are provided avoiding the groove section 116. As a result, the movement of the seal member 14 due to the pressure applied at the time of crimping is suppressed by the groove section 116 overlapping with the seal member 14. Therefore, according to the crimp terminal 1 of the present embodiment, it is possible to alleviate difficulties in manufacturing while securing waterproofness at a higher level.

In addition, the groove section 116 provided in the inner surface 11*a* of the barrel section 11 contributes to securing a high level of waterproofness also in the following points.

Figure 13:
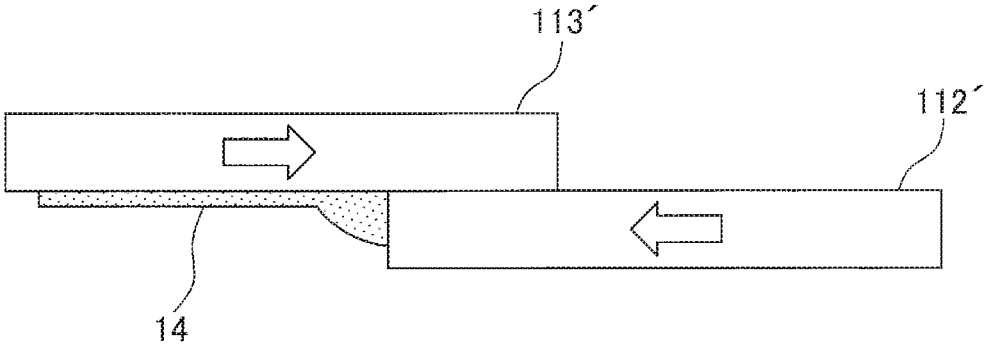
FIG. 13 is a schematic view showing an example in which a groove section is not provided on the inner surface of the barrel section as a comparative example for explaining that a groove section provided on the inner surface of the barrel section contributes to securing a high level of waterproofness.
Figure 14:
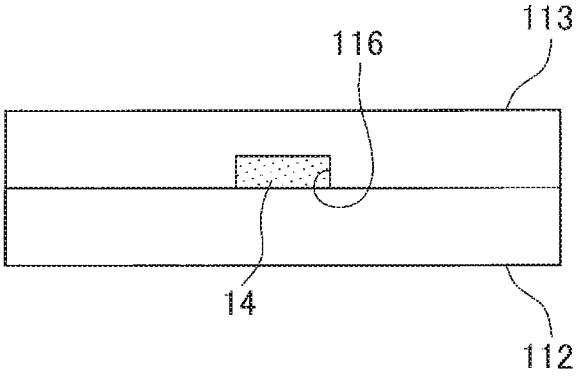
FIG. 14 is a view showing that the groove provided on the inner surface of the barrel section contributes to securing high waterproofness at a high level in comparison with the example of FIG. 13.

FIG. 13 is a schematic view showing an example in which a groove section is not provided on the inner surface of the barrel section as a comparative example for explaining that a groove section provided on the inner surface of the barrel section contributes to securing a high level of waterproofness. Further, FIG. 14 is a view showing that the groove section provided on the inner surface of the barrel section contributes to securing high waterproofness at a high level in comparison with the example of FIG. 13.

In the comparative example shown in FIG. 13, the seal member 14 affixed to the outer barrel piece 113' may be brought close to one side by the edge of the inner barrel piece 112' during crimping. In contrast, when the groove section 116 is provided so as to overlap with the seal member 14, even if the seal member 14 is forced close to one side, at least a part of the seal member 14 within the groove section 116 is secured as shown in FIG. 14. As a result, the groove section 116 provided in the inner surface 11*a* of the barrel section 11 contributes to securing high waterproofness.

Further, according to the terminal manufacturing method of the first embodiment described with reference to FIGS. 1 and 2, since the sealing member 14 is affixed in a divided state, it is possible to alleviate the difficulty in manufacturing while ensuring waterproofness against a contact portion with the aluminum core wire W1*a*. Further, according to the terminal manufacturing method of the present embodiment, since the seal member 14 is formed of the adhesive gel sheet, difficulty in manufacturing can be alleviated while ensuring waterproofness at a high level.

Here, in the crimp terminal 1 of the present embodiment, as described above, the edges of the concave sections 114 provided on the inner surface 11*a* of the barrel section 11 bite into the aluminum core wire W11 by crimping, whereby good conduction between the covered electric wire W1 and the crimp terminal 1 can be obtained. That is, it can be said that serrations are formed on the inner surface 11*a* of the barrel section 11 by providing a plurality of concave sections 114 in a dispersed manner. The degree of conduction in the serration is determined by the sum of the lengths of the portions biting into the aluminum core wire W11 per unit area.

Figure 15:
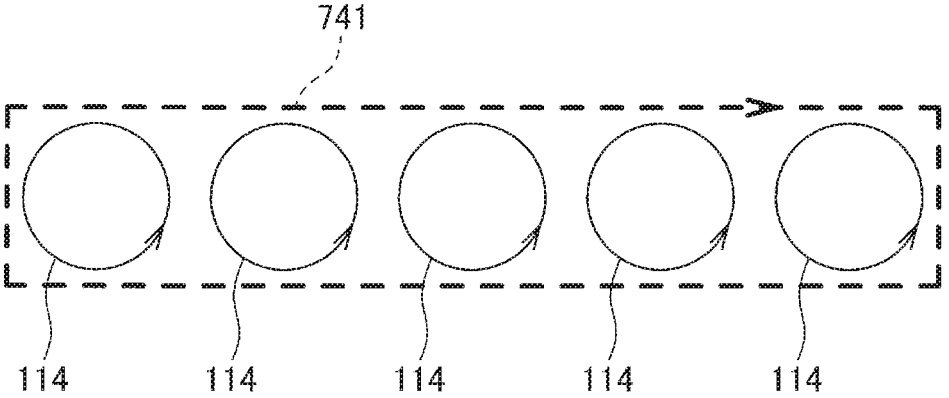
FIG. 15 is a schematic view showing that the degree of conduction with the aluminum core wire in the crimp terminal shown in FIGS. 1 to 8 is determined by the sum of the lengths of the portions biting into the aluminum core wire per unit area.

FIG. 15 is a schematic view showing that the degree of conduction with the aluminum core wire in the crimp terminal shown in FIGS. 1 to 8 is determined by the sum of the lengths of the portions biting into the aluminum core wire per unit area.

Figure 49:
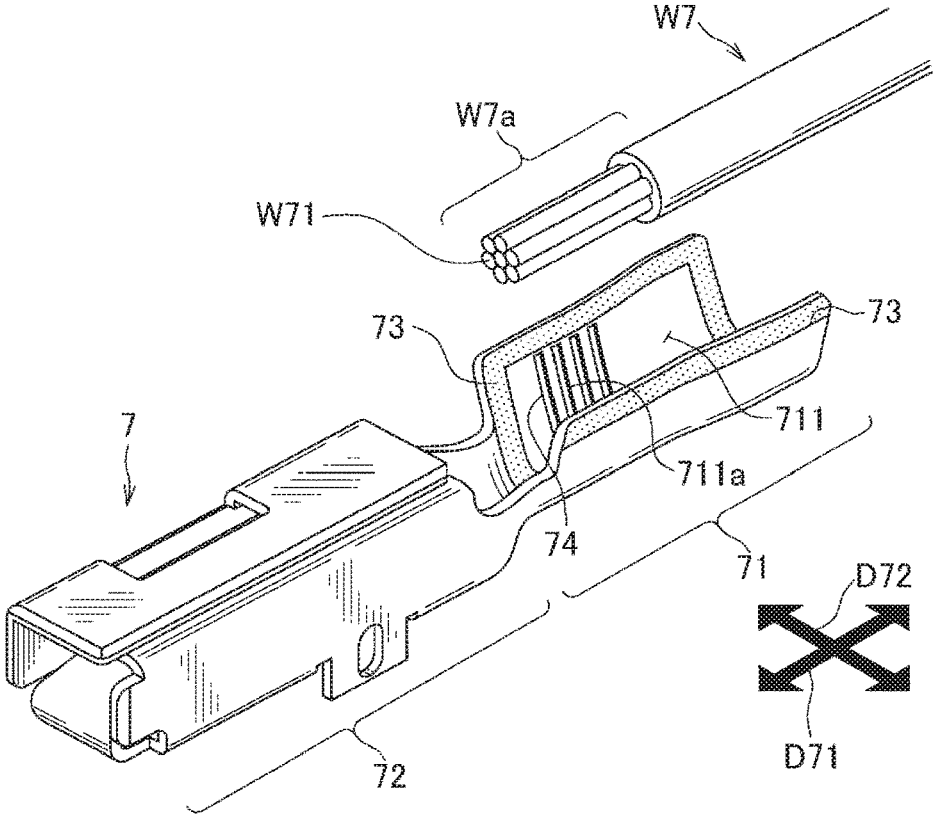
FIG. 49 PRIOR ART
FIG. 49 is a view showing an example of a conventional crimp terminal surrounding a contact portion between a barrel section and an aluminum core wire with a seal member.

In the crimp terminal 1, the sum of the lengths of the portions biting into the aluminum core wire W11 is the total of the circumferential lengths of the circular concave sections 114. On the other hand, for example, in the groove section 741 forming the serration 74 shown in FIG. 49, the sum of the lengths of the portions biting into the aluminum core wire is the sum of the lengths of the edges of the linearly extending grooves 741, but when viewed per unit area, the total of the circumferential lengths of the plurality of concave sections 114 formed in a circular shape is longer than this sum. In other words, according to the crimp terminal 1 of the present embodiment, the region of the serration necessary for obtaining good conduction between the covered electric wire W11 and the crimp terminal 1 can be suppressed as compared with, for example, the conventional crimp terminal 7. Since the area of the serration is suppressed, a space for providing the seal member 14 can be widened in order to ensure waterproofing against the contact portion with the aluminum core wire W11, and it is possible to alleviate the difficulty in manufacturing. That is, according to the crimp terminal 1 of the present embodiment, it is possible to alleviate difficulties in manufacturing while securing waterproofness against the contact portion with the aluminum core wire W11 also in this respect.

In addition, the circular concave sections 114 are stronger in resisting force against the force of expanding the concave sections 114 in the in-plane direction of the inner surface 11*a* of the barrel section 11 than, for example, a linear groove or the like. The pressure applied to the barrel section 11 at the time of crimping is just the force acting in the in-plane direction of the inner surface 11*a* of the barrel section 11. In the crimp terminal 1 of the present embodiment, the resistance force at each concave section to such pressure is strong.

Figure 16:
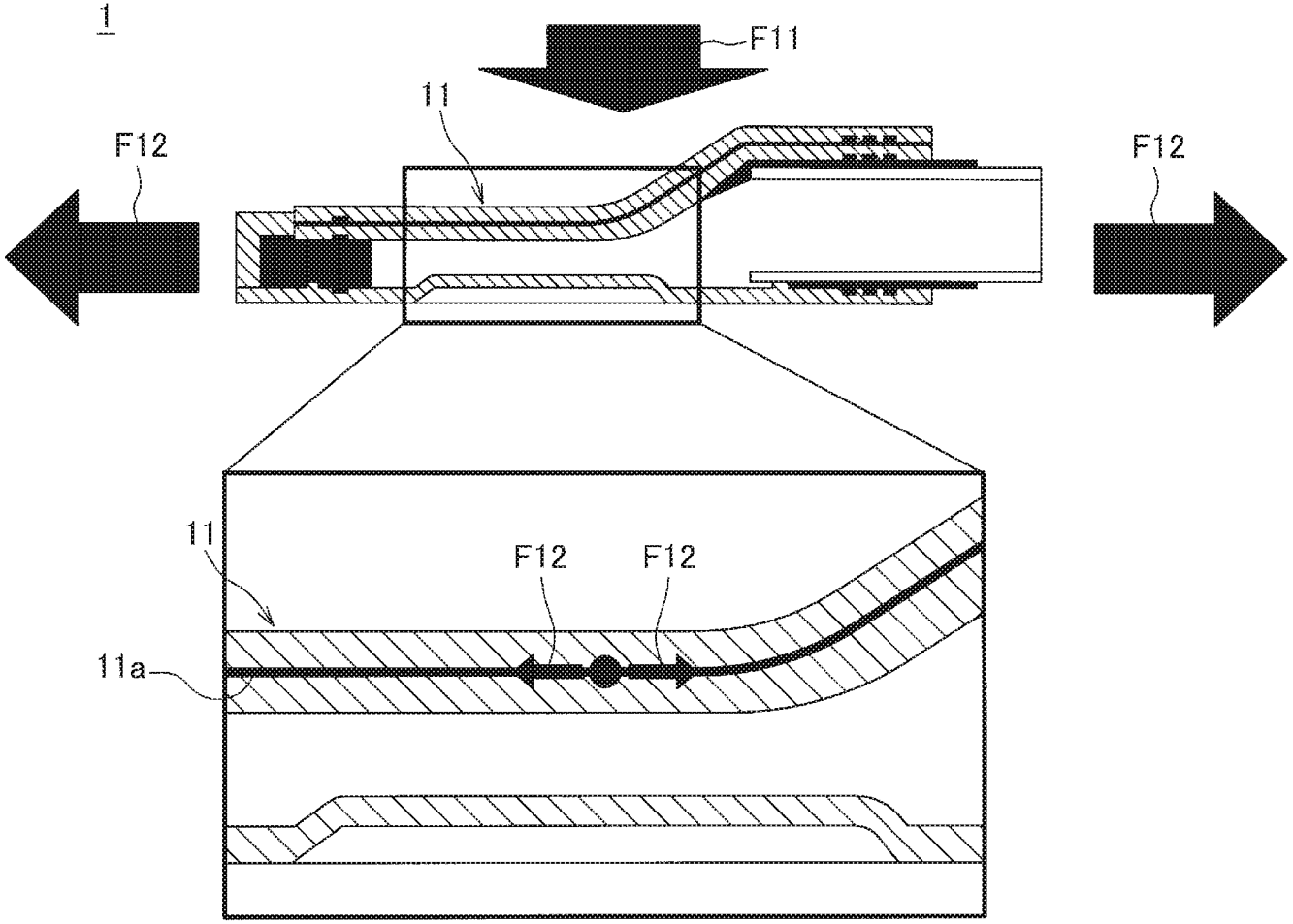
FIG. 16 is a schematic view showing the pressure applied to the barrel section during crimping.

FIG. 16 is a schematic view showing the pressure applied to the barrel section during crimping.

As shown in FIG. 16, at the time of crimping, a force F11 for crushing the barrel section 11 of the crimp terminal 1 is applied to the barrel section 11 by a pressing device or the like (not shown). When such a force F11 is applied, a force F12 for expanding the concave sections 114 in the in-plane direction of the inner surface 11*a* is generated in the barrel section 11.

Figure 17:
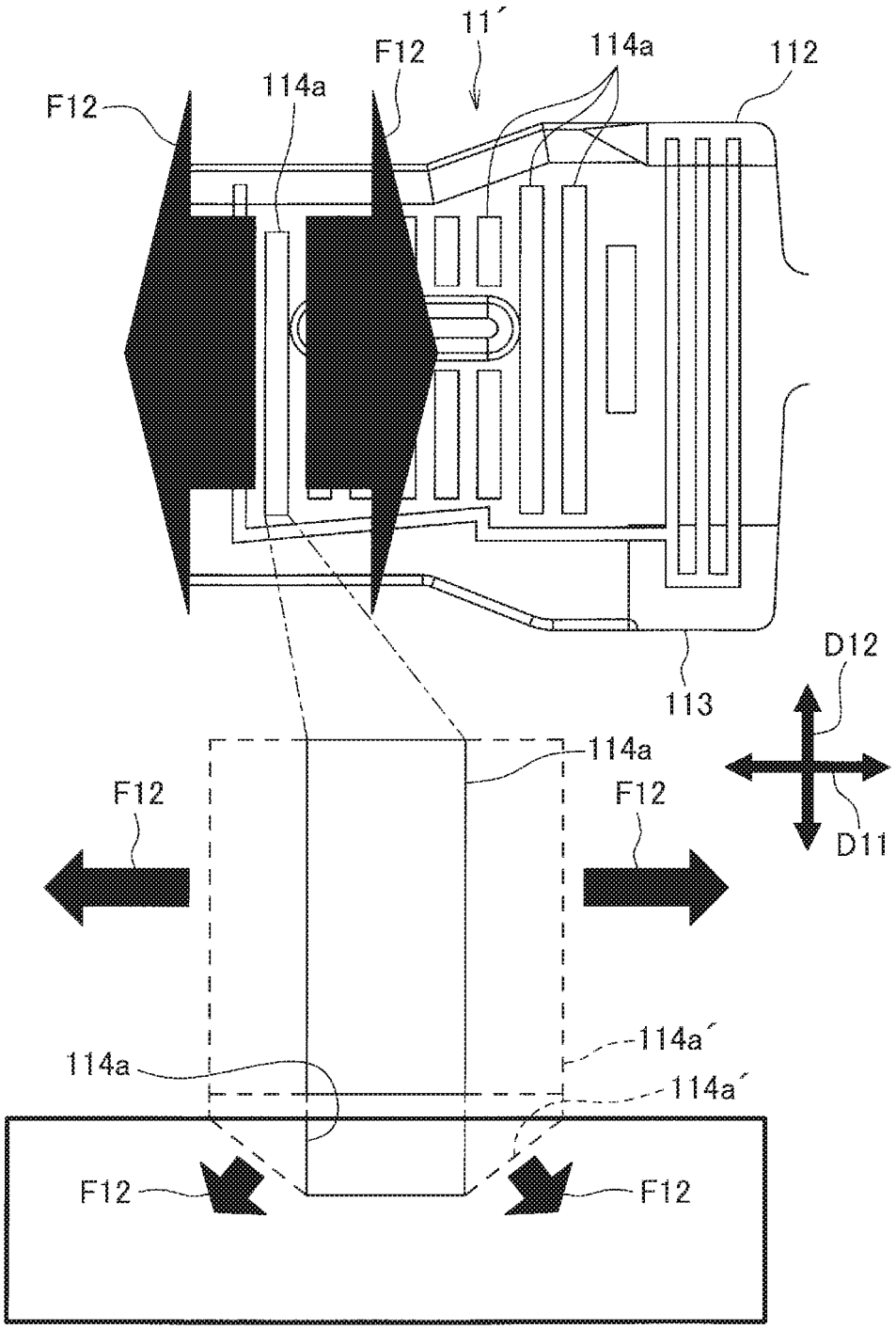
FIG. 17 is an explanatory view for explaining an influence due to a force generated at the barrel section at the time of crimping with a barrel section provided with a linear groove instead of a concave section as a comparative example.

FIG. 17 is an explanatory view for explaining an influence due to a force generated at the barrel section at the time of crimping with a barrel section provided with a linear groove instead of a concave section as a comparative example. Incidentally, in this FIG. 17, the same reference numerals as those in FIGS. 1 to 8 denote the same constituent elements as those shown in FIGS. 1 to 8, and in the following description, the duplicate explanation of the same constitute elements will be omitted.

In the comparative example of FIG. 17, a plurality of linear grooves 114*a* are provided in parallel in place of the circular recesses 114 of the crimp terminal 1 of the first embodiment serving as serrations. Each of the grooves 114*a* is provided along the crossing direction D12 that intersects the axial direction D11. In this comparative example, when a force F12 in the in-plane direction as shown in FIG. 16 is applied, each groove 114*a* is deformed into a deforming groove 114 *a*' whose width is widened. By deforming each groove 114*a* into the deforming groove 114*a*', the barrel section 11' extends in the axial direction D11. In this case, the seal member 14 provided in the barrel section 11' also follows and extends, but if this extension is excessively large, for example, in the seal member 14 etc. between the inner barrel piece 112 and the outer barrel piece 113, the seal unevenness or the like of the seal member 14 occurs, which may lower the waterproof property.

In contrast to this comparative example, in the crimp terminal 1 of the first embodiment, the resistance force against the force F12 that tends to widen the concave section 114 in the in-plane direction of the inner surface 11*a* is strong.

Figure 18:
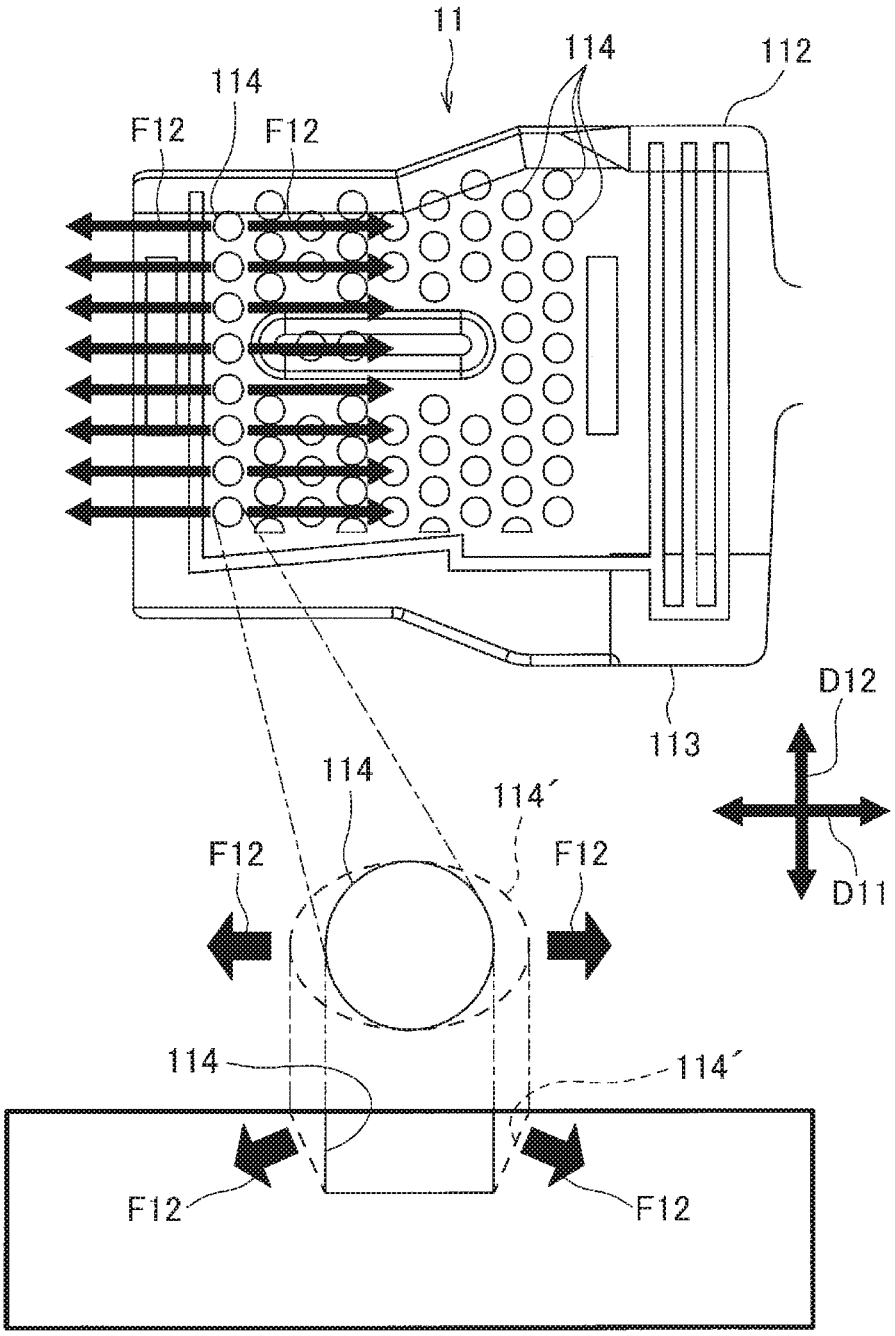
FIG. 18 is an explanatory view for explaining the resistance force against the force to widen the concave section is strong in the crimp terminal of the first embodiment.

FIG. 18 is an explanatory view for explaining the resistance force against the force to widen the concave section is strong in the crimp terminal of the first embodiment.

In the circular concave section 114, most of the inner peripheral surface of the circular concave section 114 obliquely intersects the force F12 and acts to suppress deformation that expands the concave section 114. Thereby, in the crimp terminal 1 of the present embodiment, extension of the barrel section 11 due to the pressure F11 applied during crimping is suppressed. As a result, extension of the seal member 14 is also suppressed, and waterproofness can be secured at a high level. According to the crimp terminal 1 of this embodiment, also in this sense, it is possible to alleviate difficulties in manufacturing while securing waterproofness against a contact portion with the aluminum core wire W1*a*.

Hereinafter, as another modification other than the first modification and the second modification to the crimp terminal 1 of the first embodiment, a modification of the concave section 114 provided on the inner surface 11*a* of the barrel section 11 will be described.

Figure 19:
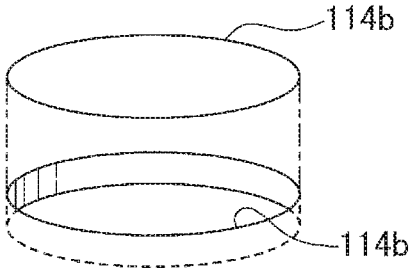
FIG. 19 is a view showing a concave section according to a third modification to the crimp terminal of the first embodiment shown in FIGS. 1 to 8.
Figure 20:
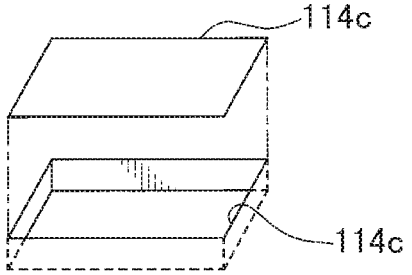
FIG. 20 is a view showing a concave section according to a fourth modification to the crimp terminal of the first embodiment shown in FIGS. 1 to 8.
Figure 21:
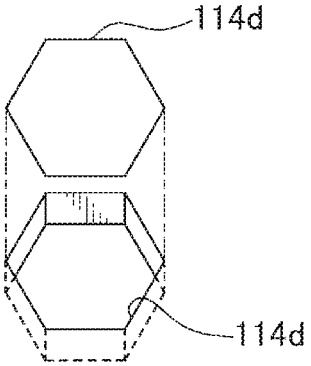
FIG. 21 is a view showing a concave section according to a fifth modification to the crimp terminal of the first embodiment shown in FIGS. 1 to 8.

FIG. 19 is a view showing a concave section according to a third modification to the crimp terminal of the first embodiment shown in FIGS. 1 to 8. Further, FIG. 20 is a view showing a concave section according to a fourth modification to the crimp terminal of the first embodiment shown in FIGS. 1 to 8. Further, FIG. 21 is a view showing a concave section according to a fifth modification to the crimp terminal of the first embodiment shown in FIGS. 1 to 8.

The concave section 114*b* in the third modification shown in FIG. 19 is formed in an elliptical shape in plan view. In addition, the concave section 114*c* in the fourth modification shown in FIG. 20 is formed in a parallelogram in plan view. Further, the concave section 114*d* in the fifth modification shown in FIG. 21 is formed in a hexagonal shape in plan view.

Besides these, as a modification of the crimp terminal 1 of the first embodiment, a triangle or another polygon in plan view and the like can be cited. In any of these modifications, as compared with the linear groove 114*a* shown in FIG. 17, the resistance force against the force F12 to expand in the in-plane direction of the inner surface 11*a* is strong. Incidentally, the elliptical concave section 114*b* in the third modification has similar strength as the circular concave section 114 in the first embodiment. On the other hand, in the parallelogram-shaped concave section 114*c* in the fourth modification and the hexagonal concave section 114*d* in the fifth modification the resistance force is weak compared with the circular concave section 114 in the first embodiment and the elliptical concave section 114*b* in the third modification.

Here, in the crimp terminal 1 of the first embodiment, as described above, a part of the plurality of concave sections 114 provided on the inner surface 11*a* of the barrel section 11 overlaps with the seal member 14. The crimp terminal 1 of the first embodiment has the following advantages in this respect.

Figure 22:
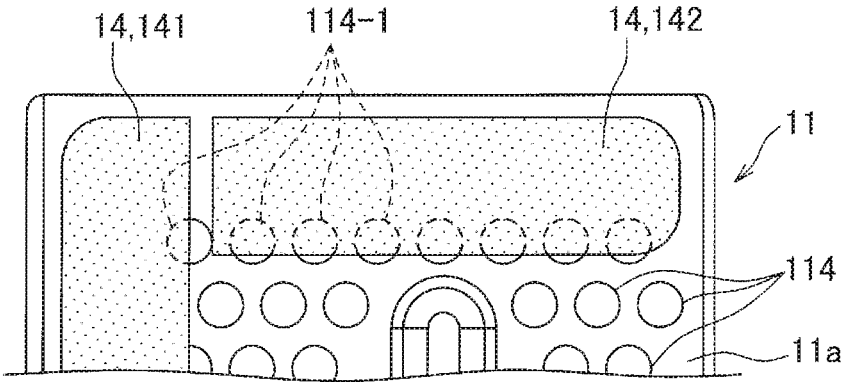
FIG. 22 is an explanatory view for explaining an advantageous point that a part of a plurality of concave sections overlaps with a seal member.

FIG. 22 is an explanatory view for explaining an advantageous point that a part of a plurality of concave sections overlaps with a seal member.

In the crimp terminal 1 of the first embodiment, firstly, the first seal portion 141 of the seal member 14 to be affixed to the outer barrel piece 113 side partially overlaps with the concave section 114-1 of the plurality of concave sections 114 positioned at the edge side of the outermost barrel piece 113. Thereby, the concave section 114-1 at a position overlapping with the first seal portion 141 can be used as a mark for providing the first seal portion 141 on the inner surface 11*a* of the barrel section 11. Also, the second seal portion 142 to be affixed to the terminal section 12 side partially overlaps with the concave sections 114-1 located closest to the terminal section 12. Thereby, the concave sections 114-1 at a position overlapping with the second seal portion 142 can be used as a mark for providing the second seal portion 142 on the inner surface 11*a* of the barrel section 11. According to the crimp terminal 1 of the present embodiment, it is possible to alleviate difficulties in manufacturing at these points. In addition, the concave sections 114-1 overlapping with the first seal portion 141 and the second seal portion 142 suppress the movement of the first seal portion 141 and the second seal portion 142 due to the pressure applied at the time of crimping, thereby contributing to ensuring waterproofness at a higher level. In this way, according to the crimp terminal 1 of the present embodiment, by using a part of the concave sections 114 provided for good conduction between the covered electric wire W1 and the crimp terminal 1 while securing the waterproof property against the contact portion with the aluminum core wire W11, it is possible to alleviate difficulties in manufacturing.

Further, according to the crimp terminal 1 of the first embodiment, the movement of the seal member 14 due to the pressure applied at the time of crimping is also suppressed by the groove section 116 overlapping with the seal member 14. According to the crimp terminal 1 of the first embodiment, it is possible to alleviate difficulties in manufacturing while securing waterproofness at a higher level in this respect. Further, the groove section 116 overlapping with the seal member 14 can also be used as a marker for providing the seal member 14 on the inner surface 11*a* of the barrel section 11, and it is possible to further alleviate manufacturing difficulties in this point.

Further, in the crimp terminal 1 of the first embodiment, as described above, since a high degree of conduction is secured by forming the serrations by the plurality of concave sections 114, even if the sealing member 14 overlaps with the concave sections 114 somewhat more, the influence on conduction is small. Therefore, it is unnecessary to strictly perform the alignment when affixing the seal member 14, so that it is possible to further alleviate the manufacturing difficulty even in this point.

Next, a modification of the seal member 14 affixed to the inner surface 11*a* of the barrel section 11 will be described as another modification other than the above-described first to fifth modifications to the crimp terminal 1 of the first embodiment.

Figure 23:
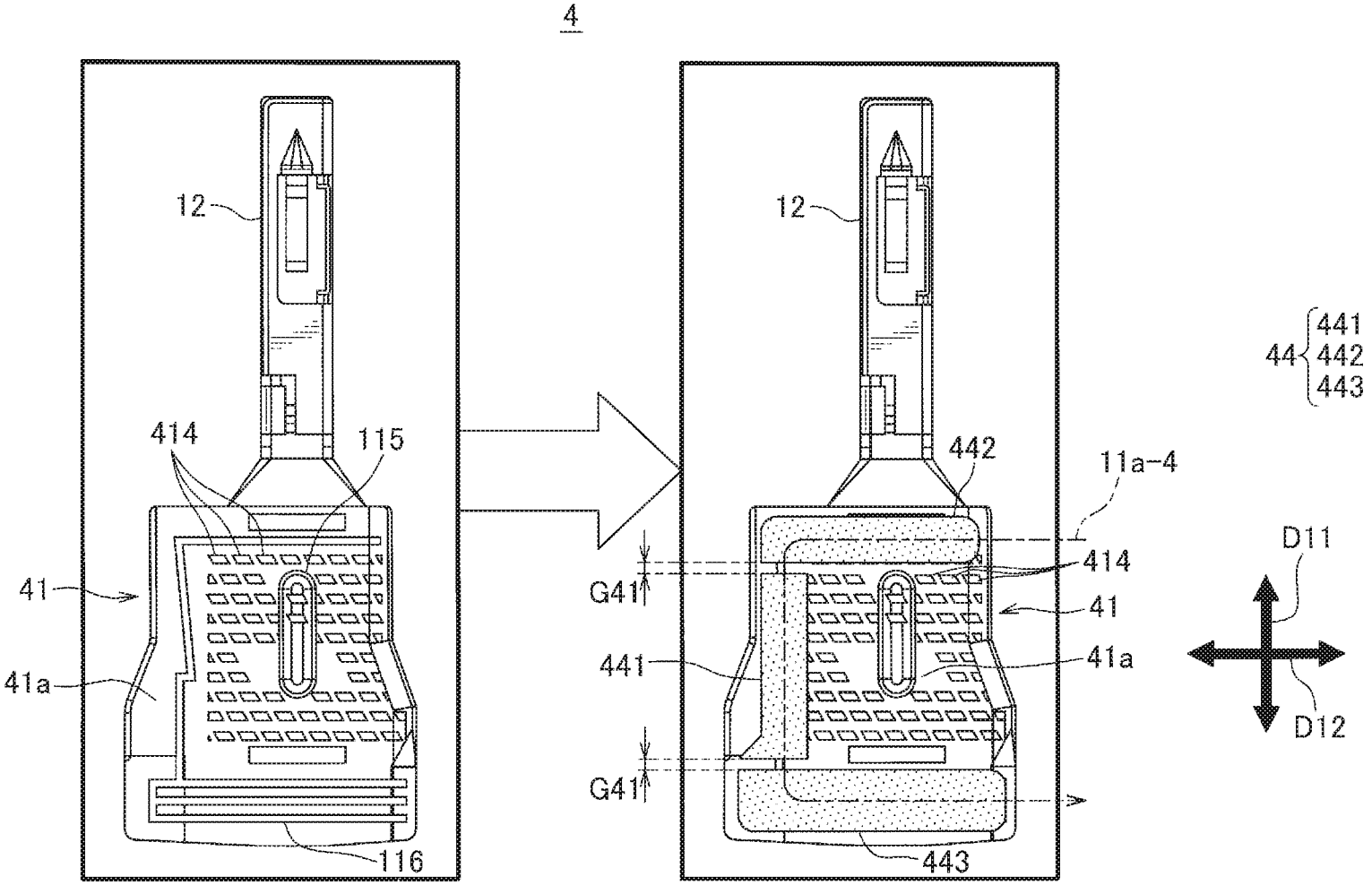
FIG. 23 is a view showing a sixth modification to the crimp terminal of the first embodiment shown in FIGS. 1 to 8.

FIG. 23 is a view showing a sixth modification to the crimp terminal of the first embodiment shown in FIGS. 1 to 8. In the sixth modification, not only the shape of the seal member but also the shape of the concave section are different from the crimp terminal 1 of the first embodiment. Further, in FIG. 23, the same reference numerals as those in FIGS. 1 to 8 denote the same constituent elements as those shown in FIGS. 1 to 8, and in the following description, the duplicate explanation of the same constitute elements will be omitted.

In the crimp terminal 4 according to the sixth modification, firstly, the concave section 414 provided in the inner surface 41*a* of the barrel section 41 is a concave section of a parallelogram in a plan view as shown as the fourth modification in FIG. 20.

In the seal member 44 according to the sixth modification, the second seal portion 442 and the third seal portion 443 are each divided from the first seal portion 441 across the path 11*a*-4 in the crossing direction D12. A slight gap G41 opens in the axial direction D11 between the second seal portion 442 and the first seal portion 441, and between the third seal portion 443 and the first seal portion 441. The gap G41 is closed by the extension of the seal member 44 at the time of crimping.

Figure 24:
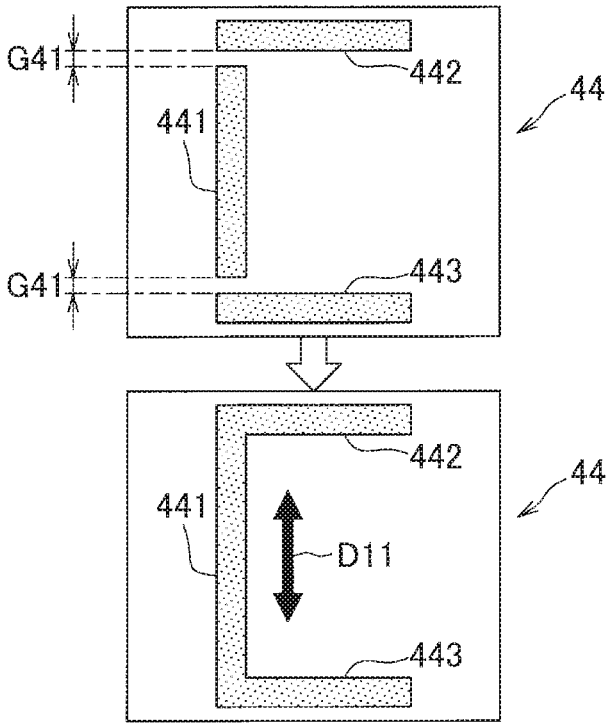
FIG. 24 is a schematic view showing how the gap between the second seal portion and the first seal portion and between the third seal portion and the first seal portion shown in FIG. 23 is closed by extension of the seal member at the time of crimping.

FIG. 24 is a schematic view showing how the gap between the second seal portion and the first seal portion and between the third seal portion and the first seal portion shown in FIG. 23 is closed by extension of the seal member at the time of crimping.

As shown in FIG. 24, at the time of crimping, the first seal portion 441 is extended in the axial direction D11 which coincides with the length direction thereof. Due to this extension, the second seal portion 442 and the third seal portion 443 are connected to the first seal portion 441, and the gap G41 is closed. Incidentally, the extension ratio at the time of crimping is larger in the crossing direction D12 than in the axial direction D11. Therefore, although the extent of extension becomes smaller as compared with the case of the first embodiment described with reference to FIG. 7 and the like. However, by appropriately adjusting the gap G41 generated at the time of affixing, the gap G41 is closed at the time of crimping, and a high level of waterproofness can be secured.

Next, further modification to the shape of the seal member 14 in the first embodiment will be described.

Figure 25:
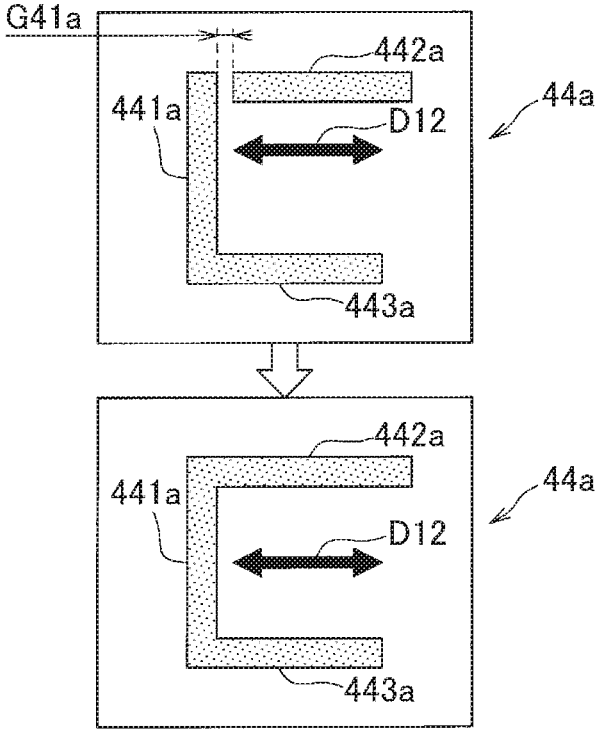
FIG. 25 is a view showing a seal member in a seventh modification to the crimp terminal of the first embodiment shown in FIGS. 1 to 8.
Figure 26:
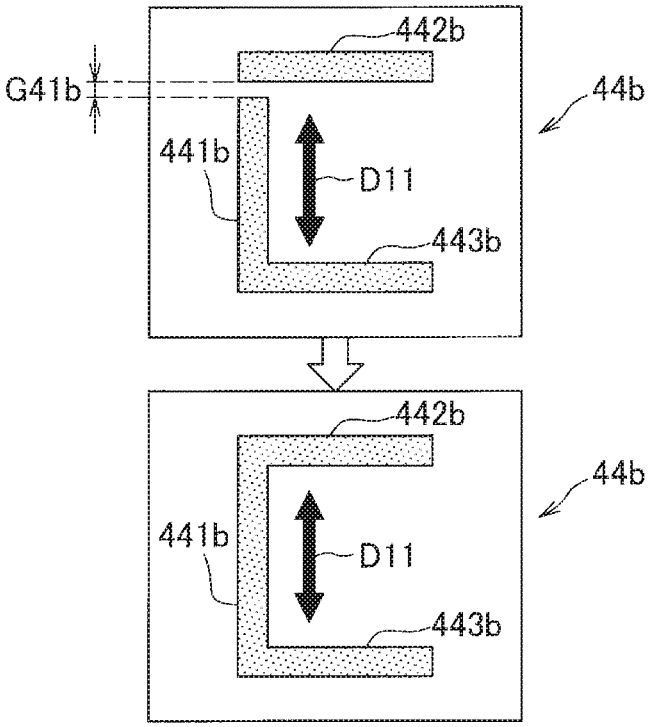
FIG. 26 is a view showing a seal member in an eighth modification to the crimp terminal of the first embodiment shown in FIGS. 1 to 8.
Figure 27:
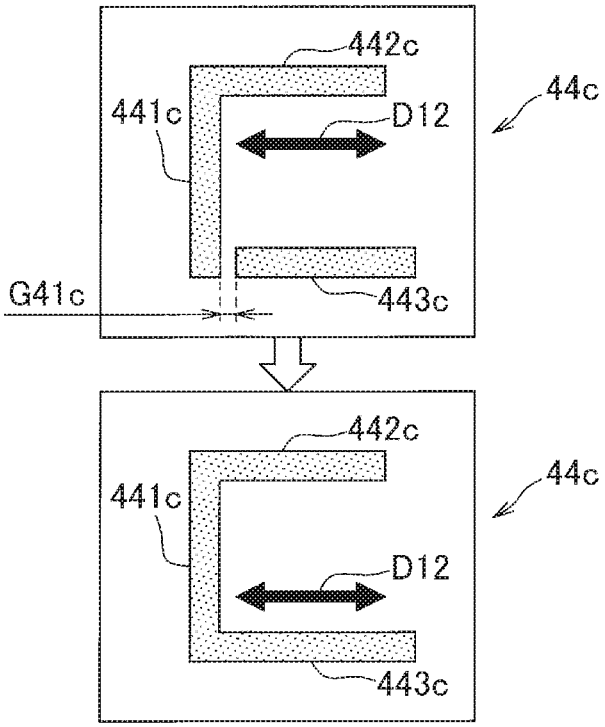
FIG. 27 is a view showing a seal member in a ninth modification to the crimp terminal of the first embodiment shown in FIGS. 1 to 8.
Figure 28:
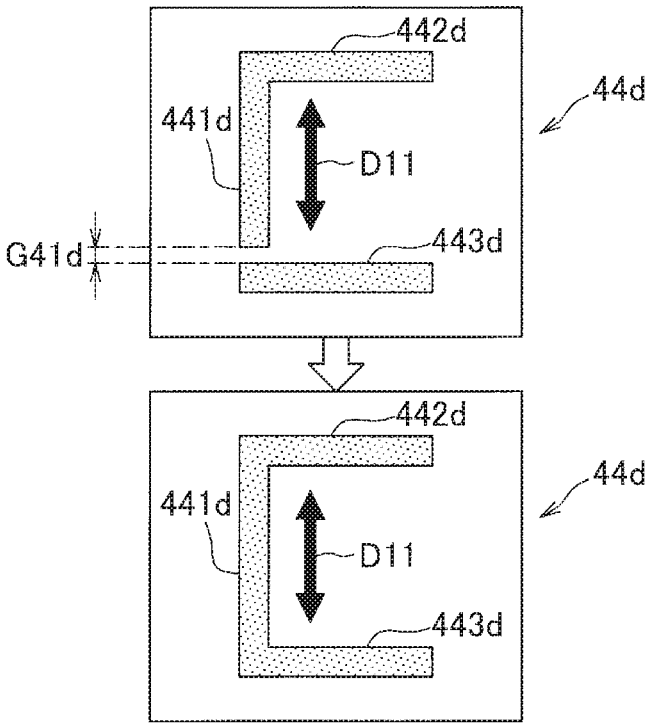
FIG. 28 is a view showing a seal member in a tenth modification to the crimp terminal of the first embodiment shown in FIGS. 1 to 8.

FIG. 25 is a view showing a seal member in a seventh modification to the crimp terminal of the first embodiment shown in FIGS. 1 to 8. Further, FIG. 26 is a view showing a seal member in an eighth modification to the crimp terminal of the first embodiment shown in FIGS. 1 to 8. Further, FIG. 27 is a view showing a seal member in a ninth modification to the crimp terminal of the first embodiment shown in FIGS. 1 to 8. Further, FIG. 28 is a view showing a seal member in a tenth modification to the crimp terminal of the first embodiment shown in FIGS. 1 to 8.

In the seal member 44*a* of the seventh modification shown in FIG. 25, the first seal portion 441*a* and the second seal portion 442*a* are divided, and a gap G41*a* in the crossing direction D12 is opened. On the other hand, the first seal portion 441*a* and the third seal portion 443*a* are connected to each other, and both are formed in an L-shape in a plan view. In other words, the seal member 44*a* is in a two-divided state. At the time of crimping, the second seal portion 442*a* is extended in the crossing direction D12. Due to this extension, the second seal portion 442*a* is connected to the first seal portion 441*a*, and the gap G41*a* is closed.

In the seal member 44*b* of the eighth modification shown in FIG. 26, the first seal portion 441*b* and the second seal portion 442*b* are divided and the gap G41*b* in the axial direction D11 is opened. On the other hand, the first seal portion 441*b* and the third seal portion 443*b* are connected to each other, and both are formed in an L-shape in a plan view. At the time of crimping, the first seal portion 441*b* is extended in the axial direction D11. Due to this extension, the first seal portion 441*b* is connected to the second seal portion 442*b*, and the gap G41*b* is closed.

In the seal member 44*c* of the ninth modification shown in FIG. 27, the first seal portion 441*c* and the third seal portion 443*c* are divided, and the gap G41*c* in the crossing direction D12 is opened. On the other hand, the first seal portion 441*c* and the second seal portion 442*c* are connected to each other, and both are formed in an inverted L-shape in a plan view. At the time of crimping, the third seal portion 443*c* is extended in the crossing direction D12. Due to this extension, the third seal portion 443*c* is connected to the first seal portion 441*c*, and the gap G41*c* is closed.

In the seal member 44*d* of the tenth modification shown in FIG. 28, the first seal portion 441*d* and the third seal portion 443*d* are divided and the gap G41*d* in the axial direction D11 is opened. On the other hand, the first seal portion 441*d* and the second seal portion 442*d* are connected to each other, and both are formed in an inverted L-shape in plan view. At the time of crimping, the first seal portion 441*d* is extended in the axial direction D11. Due to this extension, the first seal portion 441*d* is connected to the third seal portion 443*d*, and the gap G41*d* is closed.

With the above, the description including the modifications of the first embodiment is ended, and the second embodiment will be described together with the modification thereof. In the second embodiment, a plurality of concave sections provided in the inner surface of the barrel section is different from those in the first embodiment. Hereinafter, the second embodiment will be described focusing on differences from the first embodiment.

Figure 29:
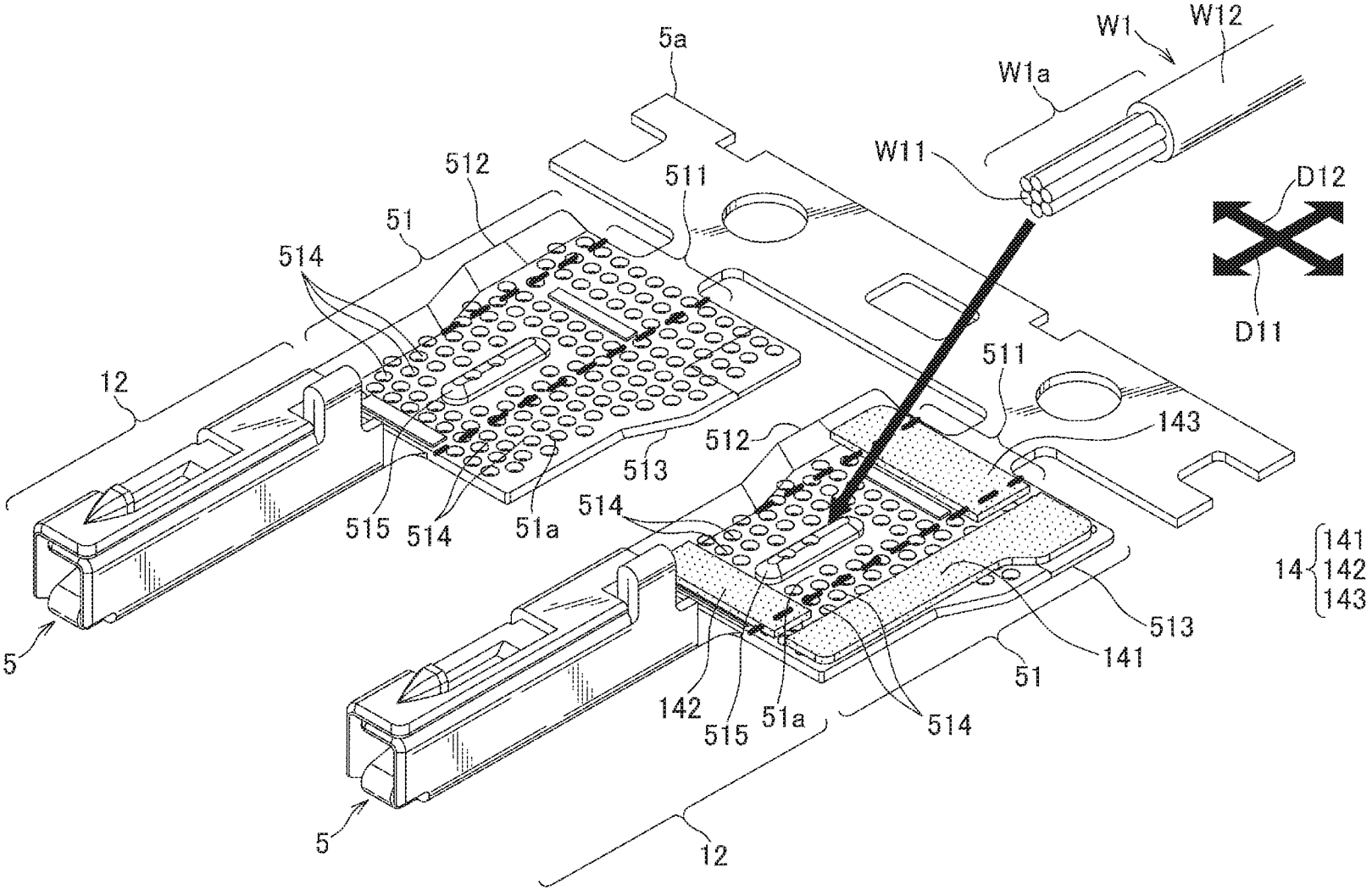
FIG. 29 is an explanatory view for explaining a crimp terminal according to a second embodiment of the present invention.
Figure 30:
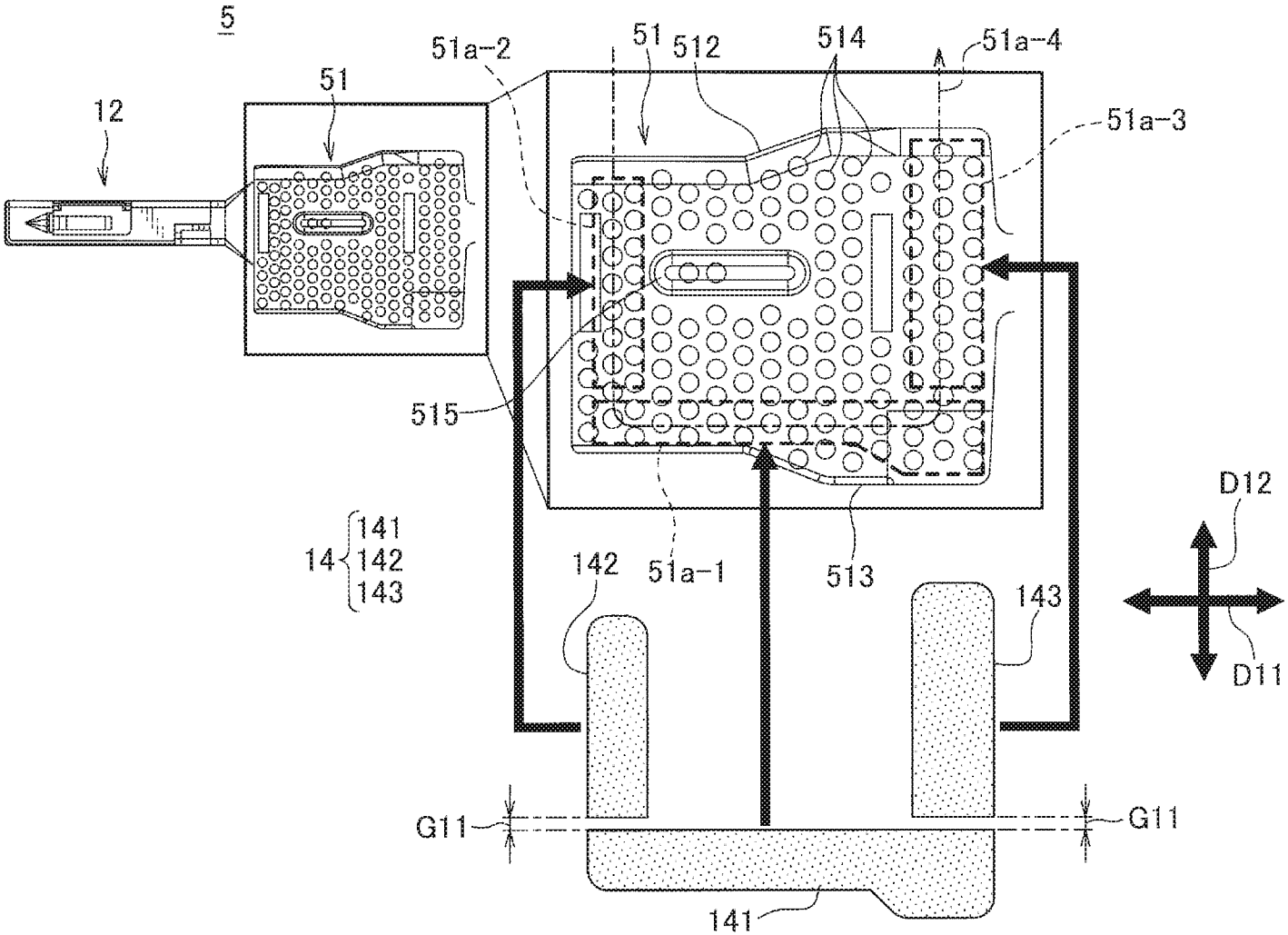
FIG. 30 is a schematic view showing how the seal member shown in FIG. 29 is affixed to the inner surface of the barrel section.

FIG. 29 is an explanatory view for explaining a crimp terminal according to a second embodiment of the present invention. FIG. 30 is a schematic view showing how the seal member shown in FIG. 29 is affixed to the inner surface of the barrel section. Incidentally, in FIGS. 29 and 30, the same reference numerals as those in FIGS. 1 to 8 denote the same constituent elements as those shown in FIGS. 1 to 8, and in the following description, the duplicate explanation of the same constitute elements will be omitted. Also in FIG. 29, two crimp terminals 5 are shown, but one crimp terminal 5 is shown with the seal member 14 removed so that the inner surface shape of the barrel section 51 can be seen.

In the crimp terminal 5 according to the present embodiment, an inner surface 51*a* of the barrel section 51 is provided with a plurality of concave sections 514 dispersedly extending over substantially the entire region including the first region 51*a*-1, the second region 51*a*-2 and the third region 51*a*-3. A convex section 515 is also formed on the inner surface 51*a* by press working from the outer surface side at a position where the aluminum core wire W11 is placed. The first region 51*a*-1 is a region that traverses longitudinally the outer barrel piece 513 in the axial direction D11. The second region 51*a*-2 is an area that traverses the inner surface 51*a* including a bottom plate portion 511 between an inner barrel piece 512 side and an outer barrel piece 513 in the crossing direction D12 closer to the terminal section 12 than the aluminum core wire W11. Further, the third region 51*a*-3 is a region traversing the inner surface 51*a* between a side of the inner barrel piece 512 and a side of the outer barrel piece 513 in the crossing direction D12 such that crossing the covered portion W12 of the end portion W1*a*.

Then, the seal member 14 composed of the first seal portion 141, the second seal portion 142, and the third seal portion 143 is affixed so as to overlap with respective concave sections 514 of the first region 51*a*-1, the second region 51*a*-2, and the third region 51*a*-3. A gap G11 is opened between the second seal portion 142 and the first seal portion 141, and between the third seal portion 143 and the first seal portion 141, crossing a path 51*a*-4 from the second region 51*a*-2 through the first region 51*a*-1 to the third region 51*a*-3 in the axial direction D11.

The crimp terminal 5 described above is manufactured by the following terminal manufacturing method.

In this terminal manufacturing method, firstly, a sheet metal working step of forming a structure before attachment of the seal member 14 is performed. In the sheet metal working step, the barrel section 51 is formed of a metal plate together with the terminal section 12. Also in this embodiment, in this sheet metal working step, the barrel section 51 and the terminal section 12 are collectively formed in a state in which a plurality of crimp terminals 5 are connected by a strip-like connecting piece 5*a*. In this sheet metal working step, formation of a plurality of concave sections 514 and formation of a convex section 515 on the inner surface 51*a* of the barrel section 51 are also performed.

Subsequently, the seal member 14 is formed of an adhesive gel sheet, and a seal member affixing step for affixing the seal member 14 over the first region 51*a*-1, the second region 51*a*-2, and the third region 51*a*-3 is carried out. This sealing member affixing step is a step of affixing the sealing member 14 in a state of being divided in a halfway of the above-mentioned path 51*a*-4. That is, the first seal portion 141, the second seal portion 142, and the third seal portion 143 are individually affixed to the inner surface 51*a* of the barrel section 51.

Also in the present embodiment, in the sealing member affixing step, the first seal portion 141, the second seal portion 142, and the third seal portion 143 are punched out from the adhesive gel sheet in the same manner as in the above-described first embodiment, and is affixed to the inner surface 51*a* of the barrel section 51.

The crimp terminal 5 manufactured in this manner is crimped to the end portion W1*a* of the covered electric wire W1 as follows.

Figure 31:
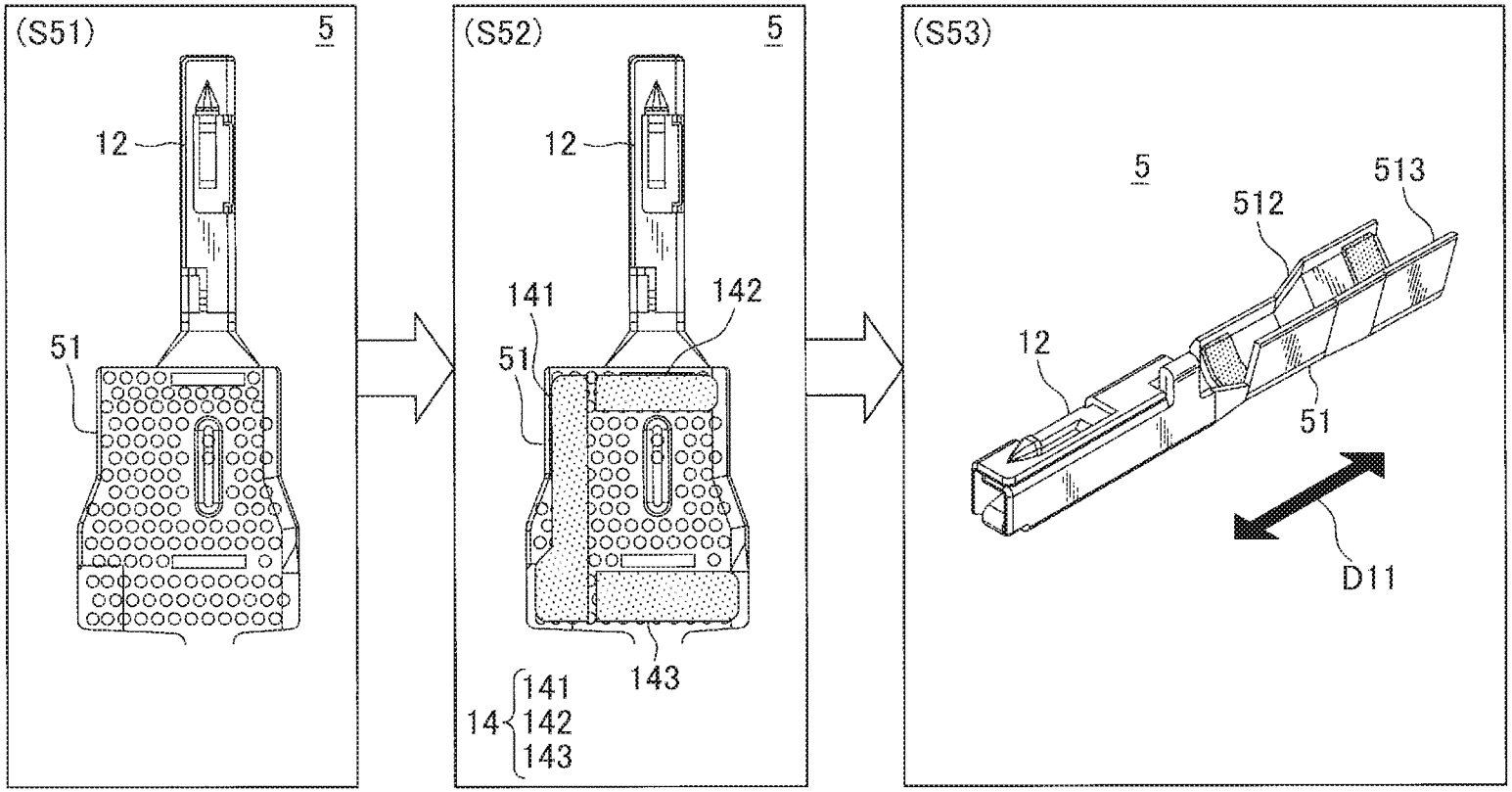
FIG. 31 is a view showing a procedure until the preparation for crimping to the end portion of the covered electric wire is completed for the crimp terminal shown in FIGS. 29 and 30.
Figure 32:
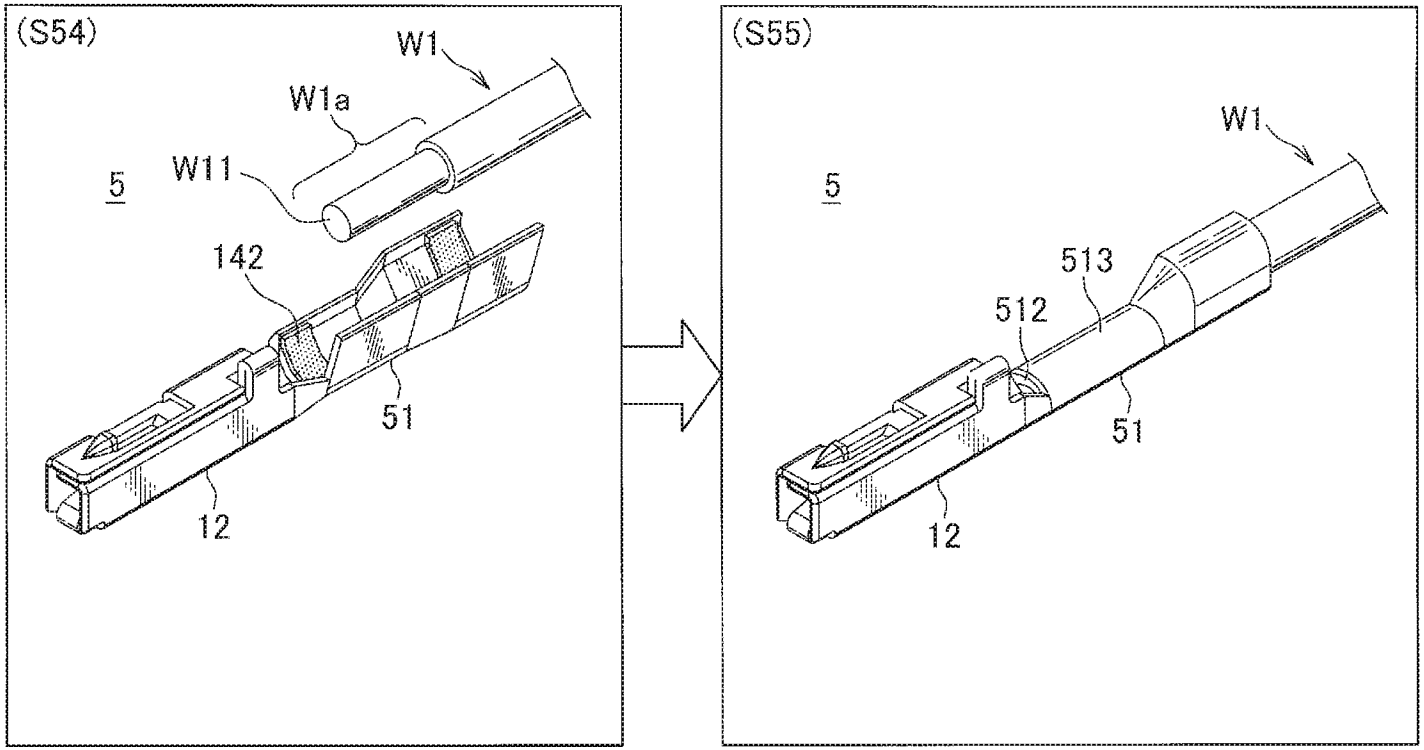
FIG. 32 is a view showing the procedure until the crimp terminal is crimped to the end portion of the covered electric wire following the procedure shown in FIG. 31.

FIG. 31 is a view showing a procedure until the preparation for crimping to the end portion of the covered electric wire is completed for the crimp terminal shown in FIGS. 29 and 30. FIG. 32 is a view showing the procedure until the crimp terminal is crimped to the end portion of the covered electric wire following the procedure shown in FIG. 31.

FIG. 31 also shows the sheet metal working step (S51) and the seal member affixing step (S52) in the terminal manufacturing method described above. In the sheet metal working step (S51), the barrel section 51 and the terminal section 12 are formed, and in the sealing member affixing step (S52), the first sealing portion 141, the second sealing portion 142, and the third sealing portion 143 constituting the seal member 14 are affixed.

Upon crimping to the end portion W1*a* of the covered electric wire W1, firstly, the crimp terminal 5 to be crimped is separated from the connecting piece 5*a* shown in FIG. 29. Then, the barrel section 51 is subjected to bending deformation as preparation for placing the end portion W1*a* of the covered electric wire W1 (S53). This bending deformation is performed such that the inner barrel piece 512 and the outer barrel piece 513 are brought close to each other so that a cross section intersecting with the axial direction D11 is substantially U-shaped.

Subsequently, the end portion W1*a* of the covered electric wire W1 is placed on the barrel section 51 after the bending deformation (S54). At this time, the end portion W1*a* is placed so that a tip of the aluminum core wire W11 does not overlap with the second seal portion 142. Incidentally, overlapping of the tip of the aluminum core wire W11 with the second seal portion 142 is permitted to some extent. Subsequently, the barrel section 51 is wound around the end part W1*a* so that the outer barrel piece 513 is overlapped with the inner barrel piece 512 facing inward (S55).

By such crimping, the seal member 14 seals the various portions of the crimp terminal 5 as follows.

Figure 33:
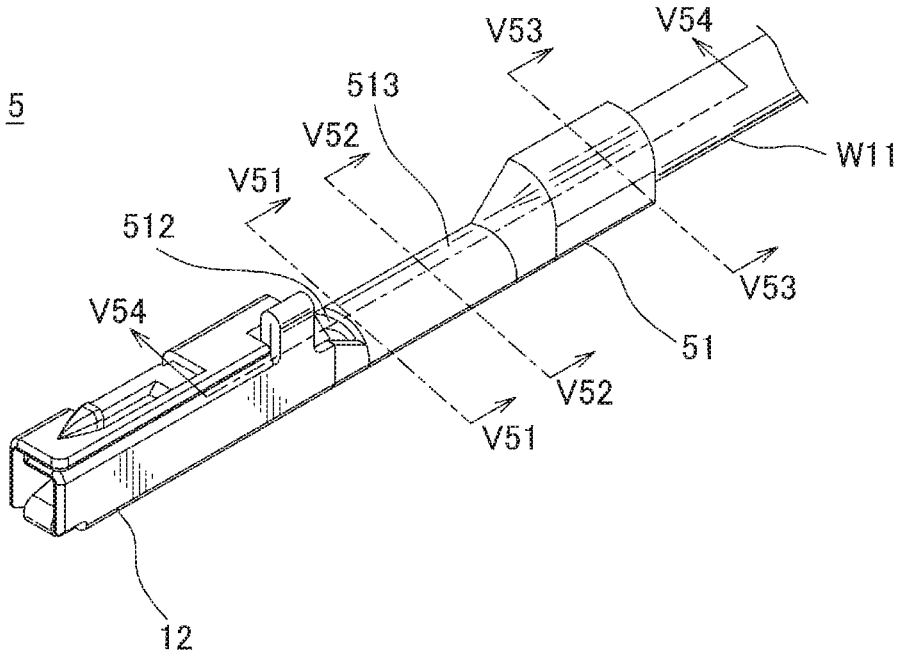
FIG. 33 is a view showing a crimp terminal after crimping also shown in FIG. 32.
Figure 34:
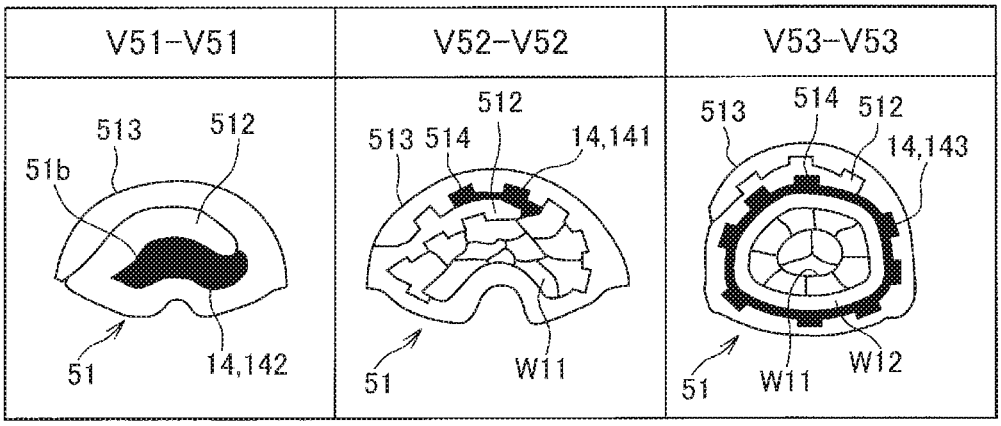
FIG. 34 is a sectional view showing a cross section taken along line V51-V51, a cross section taken along line V52-V52, and a cross section taken along line V53-V53 in FIG. 33.
Figure 35:
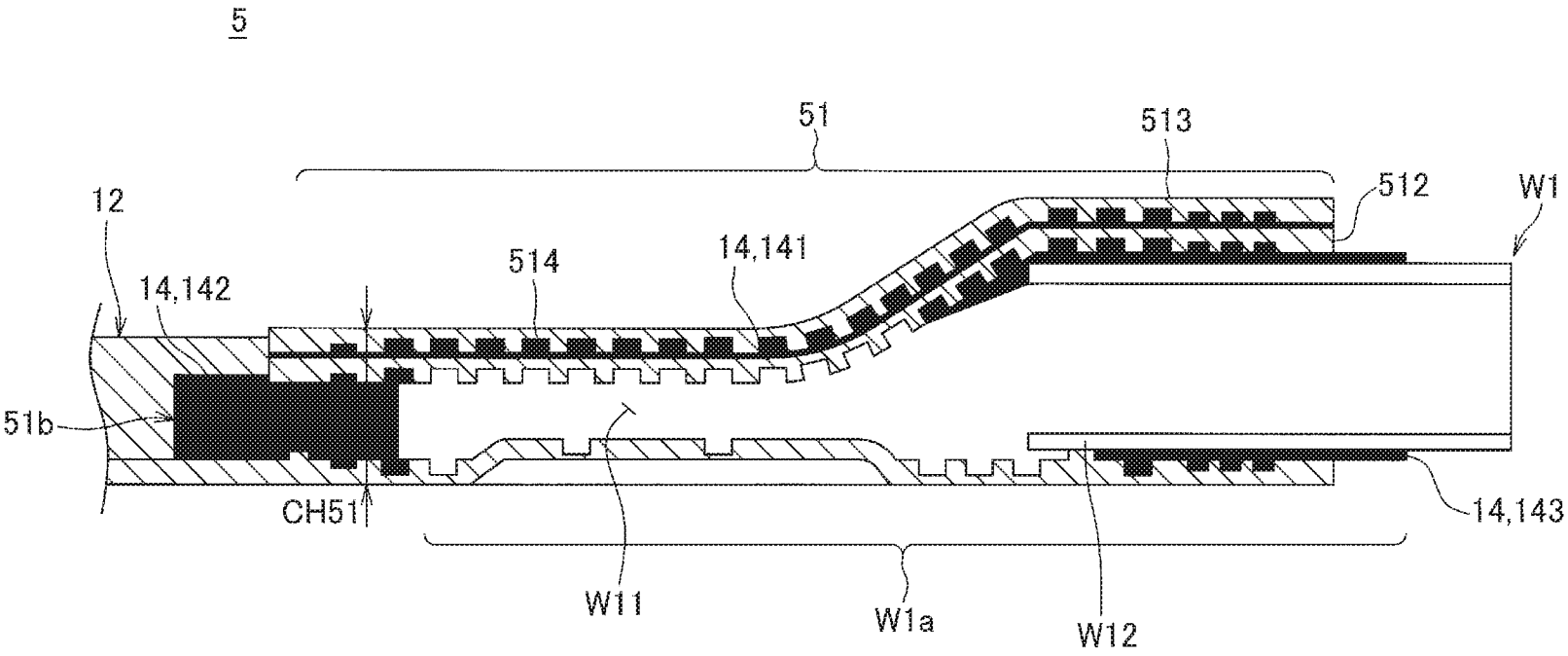
FIG. 35 is a sectional view taken along line V54-V54 in FIG. 33.

FIG. 33 is a view showing a crimp terminal after crimping also shown in FIG. 32. FIG. 34 is a sectional view showing a cross section taken along line V51-V51, a cross section taken along line V52-V52, and a cross section taken along line V53-V53 in FIG. 33. Further, FIG. 35 is a sectional view taken along line V54-V54 in FIG. 33.

In the present embodiment, the concave sections 514 overlapping the seal member 14 plays a role of the groove section 116 in the first embodiment. During the crimping, the movement of the seal member 14 due to the pressure applied at the time of crimping is suppressed by the concave sections 514 overlapping with the seal member 14. Upon crimping, the gap G11 between the second seal portion 142 and the first seal portion 141, and between the third seal portion 143 and the first seal portion 141 is closed by the extension of the second seal portion 142 and the third seal portion 143 in the crossing direction D11. After crimping, a space between the inner barrel piece 512 and the outer barrel piece 513 is sealed with the first seal portion 141 of the seal member 14. In addition, an opening 51*b* of the tubular barrel section 51 at a side of the terminal section 12 is sealed with the second seal portion 142, and a space between the covered portion W12 and the barrel section 51 is sealed with the third seal portion 143.

The crimp height CH51 of the barrel section 51 after crimping is set to such a size that the tubular barrel section 51 is crushed to such an extent that a part of the seal member 14 protrudes from the opening 51*b* of the barrel section 51. As a result, the opening 51*b* of the barrel section 51 is sealed at a high level. A part of the seal member 14 also protrudes from the space between the covering portion W12 and the barrel section 51 even on an extending side of the covered electric wire W1 in the barrel section 51 to seal this part at a high level. The dimensions such as the widths of the first seal portion 141, the second seal portion 142, and the third seal portion 143 constituting the seal member 14 have dimensions necessary and sufficient for such sealing after crimping. Further, by sealing the opening of the barrel section 51 with the seal member 14 which protrudes from the opening 51*b* and the opposite side thereof, it is possible to visually check the sealing at those locations.

In the crimp terminal 5 of the second embodiment described above, the edges of the concave sections 514 provided on the inner surface 51*a* of the barrel section 51 bites into the aluminum core wire W11 by crimping so that good conduction between the covered electric wire W1 and the crimp terminal 5 is obtained. Further, a part of the plurality of concave sections 514 provided on the inner surface of the barrel section 51 overlaps with the sealing member 14 for securing waterproofness against a contact portion with the aluminum core wire W11. Therefore, it is possible to utilize the concave sections 514 at the position overlapping the seal member 14 as a mark for providing the seal member 14 on the inner surface 51*a* of the barrel section 51, and it is possible to alleviate the difficulty in manufacturing at this point. In addition, the concave sections 514 overlapping with the seal member 14 suppress the movement of the seal member 14 due to the pressure applied at the time of crimping, thereby contributing to ensuring a higher level of waterproofness. In this way, according to the crimp terminal 5 of the present embodiment, by using a part of the concave sections 514 provided for good conduction between the covered electric wire W1 and the crimp terminal 5 while securing the waterproof property against the contact portion with the aluminum core wire W11, it is possible to alleviate difficulties in manufacturing.

Further, according to the crimp terminal 5 of the present embodiment, since the inner surface shape of the barrel section 51 is simplified such that a plurality of concave sections 514 are distributed over substantially the entire area, it is possible to further alleviate the manufacturing difficulty with respect to the molding of the barrel section 51. In addition, when providing the seal member 14, if the seal member 14 is provided along the outer periphery of the barrel section 51, and even if the seal member 14 is somewhat inclined or the like, the seal member 14 and the concave sections 514 can be provided so as to overlap each other. That is, since a high positional accuracy is unnecessary when providing the seal member 14, it is possible to further alleviate manufacturing difficulty even in this respect.

Next, as a modification of the crimp terminal 5 of the second embodiment, modifications of the manner of attachment and the shape of the seal member 14 to be affixed to the barrel section 51 will be described.

Figure 36:
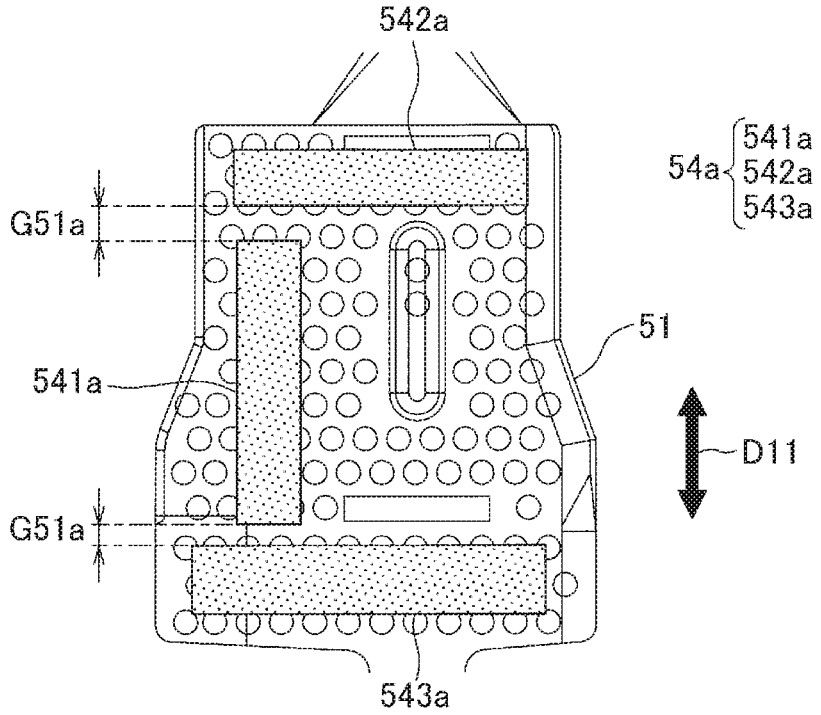
FIG. 36 is a view showing a seal member in a first modification to the crimp terminal of the second embodiment shown in FIGS. 29 to 35.
Figure 37:
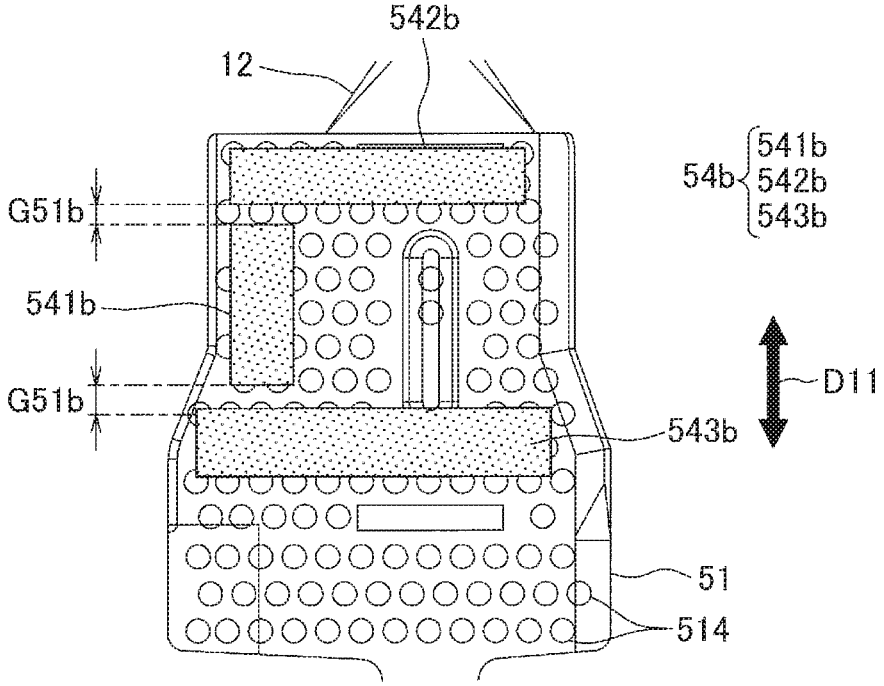
FIG. 37 is a view showing a seal member in a second modification to the crimp terminal of the second embodiment shown in FIGS. 29 to 35.
Figure 38:
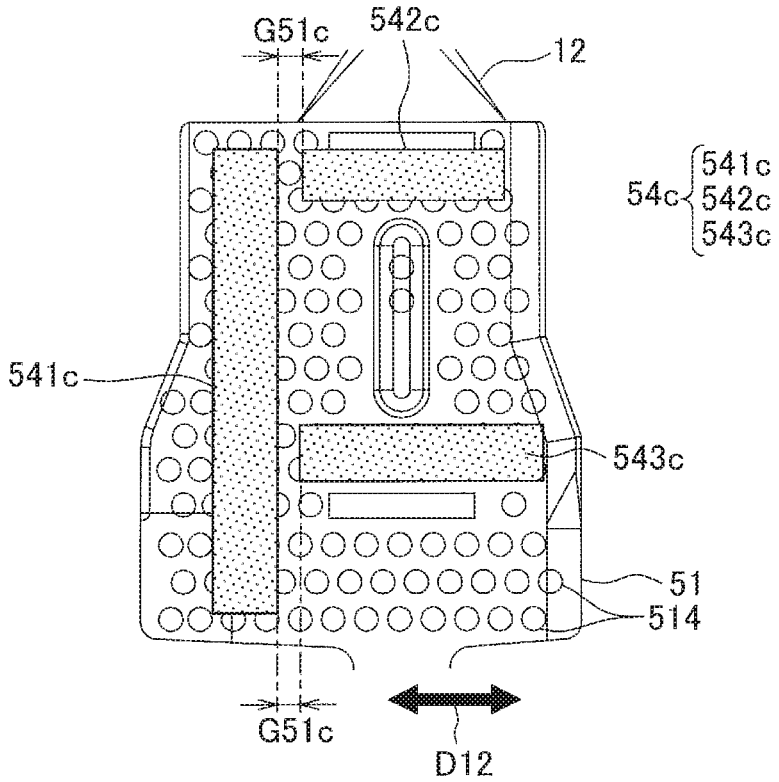
FIG. 38 is a view showing a seal member in a third modification to the crimp terminal of the second embodiment shown in FIGS. 29 to 35.
Figure 39:
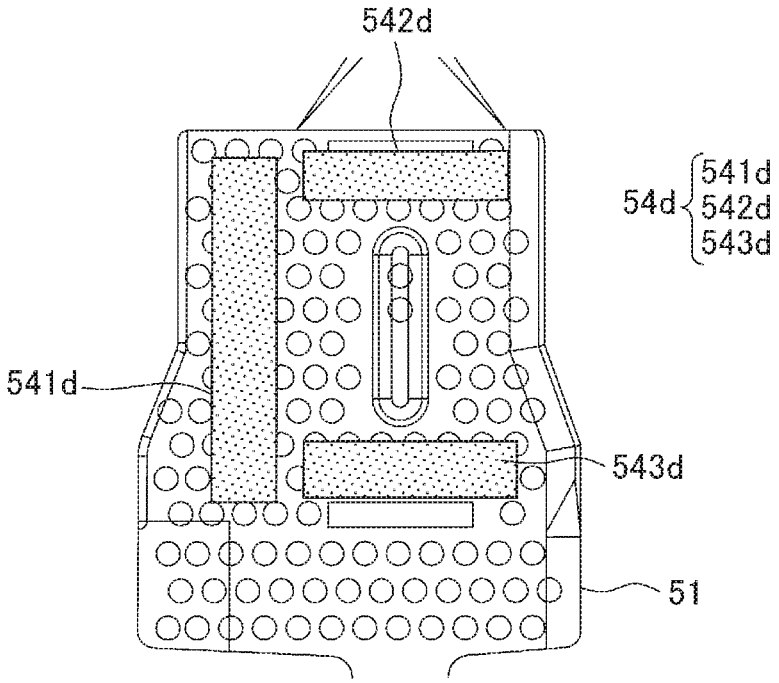
FIG. 39 is a view showing a seal member in a fourth modification to the crimp terminal of the second embodiment shown in FIGS. 29 to 35.
Figure 40:
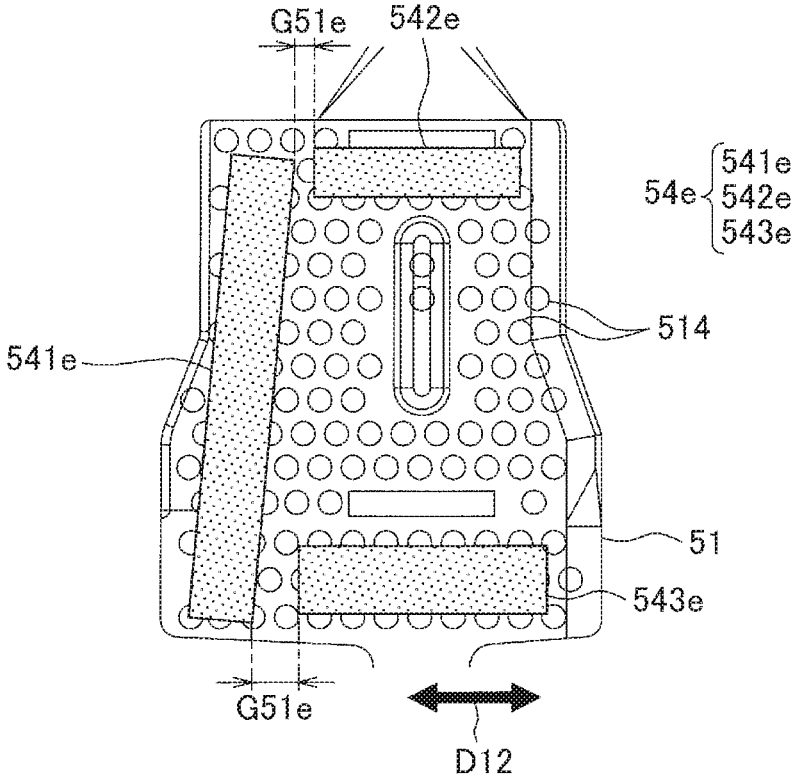
FIG. 40 is a view showing a seal member in a fifth modification to the crimp terminal of the second embodiment shown in FIGS. 29 to 35.
Figure 41:
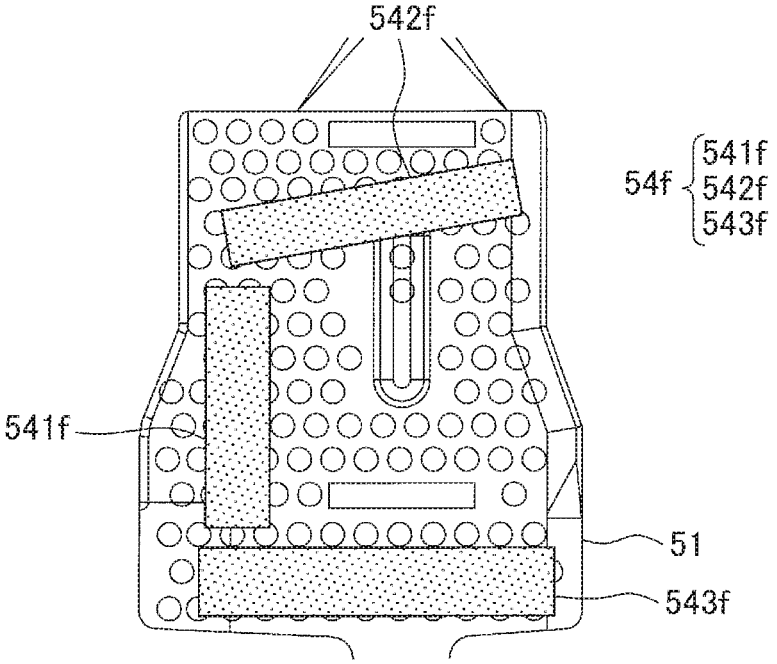
FIG. 41 is a view showing a seal member in a sixth modification to the crimp terminal of the second embodiment shown in FIGS. 29 to 35.
Figure 42:
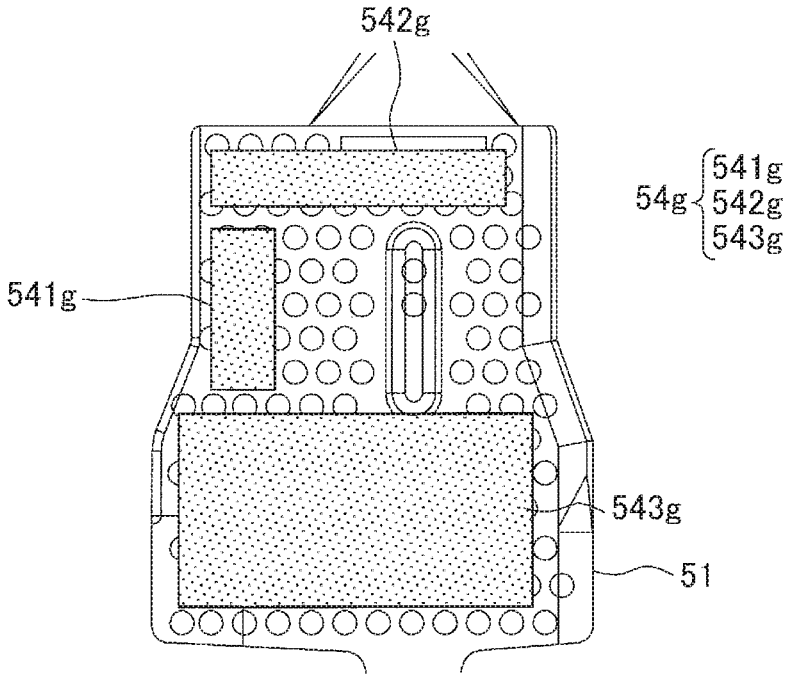
FIG. 42 is a view showing a seal member in a seventh modification to the crimp terminal of the second embodiment shown in FIGS. 29 to 35.

FIG. 36 is a view showing a seal member in a first modification to the crimp terminal of the second embodiment shown in FIGS. 29 to 35. FIG. 37 is a view showing a seal member in a second modification to the crimp terminal of the second embodiment shown in FIGS. 29 to 35. FIG. 38 is a view showing a seal member in a third modification to the crimp terminal of the second embodiment shown in FIGS. 29 to 35. FIG. 39 is a view showing a seal member in a fourth modification to the crimp terminal of the second embodiment shown in FIGS. 29 to 35. FIG. 40 is a view showing a seal member in a fifth modification to the crimp terminal of the second embodiment shown in FIGS. 29 to 35. FIG. 41 is a view showing a seal member in a sixth modification to the crimp terminal of the second embodiment shown in FIGS. 29 to 35. FIG. 42 is a view showing a seal member in a seventh modification to the crimp terminal of the second embodiment shown in FIGS. 29 to 35.

In the seal member 54*a* of the first modification shown in FIG. 36, a gap G51*a* is opened in the axial direction D11 between the second seal portion 542*a* and the first seal portion 541*a* and between the third seal portion 543*a* and the first seal portion 541*a*. In this first modification, at the time of crimping, the first seal portion 541*a* are extended in the axial direction D11 to close the gap G51*a*, thereby securing a high level of waterproofness.

In the seal member 54*b* of the second modification shown in FIG. 37, the first seal portion 541*b* is formed to be short, and the entire seal member 54*b* is located at a position biased toward the terminal section 12 as compared with the first modification. Also in the second modification, a gap G51*b* in the axial direction D11 is opened between the second seal portion 542*b* and the first seal portion 541*b* and between the third seal portion 543*b* and the first seal portion 541*b*. The gap G51*b* is closed by the extension of the seal member 54*b* at the time of crimping. In this second modification, although the region sealed by the seal member 54*b* becomes narrow, it is a prerequisite that the affixing position is set to a position where waterproofness is obtained against the contact portion between the aluminum core wire W11 and the barrel section 51. In this second modification, the affixing position of the seal member 54*b* is set on the basis of the flexibility of the affixing position due to a fact that the concave sections 514 are formed on substantially the entire surface of the barrel section 51. According to the second modification, the amount of the adhesive gel sheet used can be suppressed by a reduction in the length of the first seal portion 541*b*, so that the cost can be reduced.

In the seal member 54*c* of the third modification shown in FIG. 38, a gap G51*c* is opened in the crossing direction D12 between the second seal portion 542*c* and the first seal portion 541*c* and between the third seal portion 543*c* and the first seal portion 541*c*. The second seal portion 542*c* and the third seal portion 543*c* extend in the crossing direction D12 to close the gap G51*c* during crimping. Further, in the third modification, based on the high flexibility of the affixing position due to a fact that the concave sections 514 are formed on substantially the entire surface of the barrel section 51, the affixing position of the third seal portion 543*c* is biased toward the terminal section 12.

The seal member 54*d* in the fourth modification shown in FIG. 39 is a modification of the third modification described above, in which the first seal portion 541*d* is shortened, and the lengths of the second seal portion 542*d* and the third seal portion 543*d* are set to substantially the same length.

In the seal member 54*e* of the fifth modification shown in FIG. 40, a gap G51*e* is opened in the crossing direction D12 between the second seal portion 542*e* and the first seal portion 541*e* and between the third seal portion 543*e* and the first seal portion 541*e*. The second seal portion 542*e* and the third seal portion 543*e* are extended in the crossing direction D12 to close the gap G51*e* at the time of crimping. Further, in the fifth modification, based on the high flexibility of the affixing position due to a fact that the concave sections 514 are formed on substantially the entire surface of the barrel section 51, the first sealing portion 541*e* is tilted and affixed.

The seal member 54*f* of the sixth modification shown in FIG. 41 is a modification of the first modification shown in FIG. 36, in which the first seal portion 541*f* is shortened. Further, in the sixth modification, based on the high flexibility of the affixing position due to a fact that the concave sections 514 are formed on substantially the entire surface of the barrel section 51, the second sealing portion 542*f* is tilted and affixed. The third seal portion 543*f* is equivalent to the first modification of FIG. 36.

The seal member 54*g* of the seventh modification shown in FIG. 42 is also a modification of the first modification shown in FIG. 36. In this seventh modification, the first seal portion 541*g* is shortened and the second seal portion 542*g* is elongated. In addition, the third seal portion 543*g* is formed to be wider as it becomes longer.

As described above, in the crimp terminal 5 of the second embodiment, the concave sections 514 are formed on substantially the entire surface of the barrel section 51 as described in various modifications, so that it is possible to suitably set the affixing method and the shape of the seal member with high flexibility.

Subsequently, further modifications of the crimp terminal 5 of the second embodiment will be described.

Figure 43:
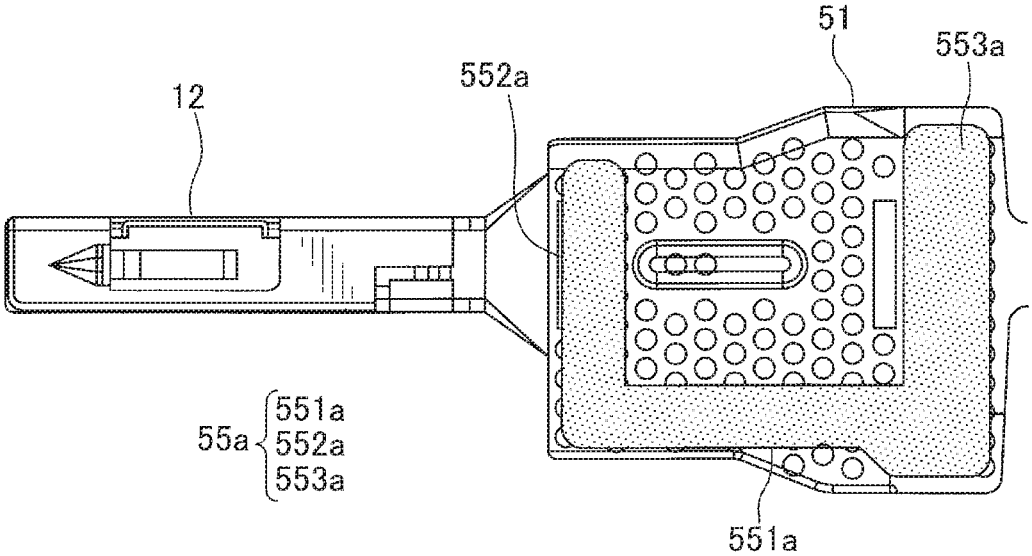
FIG. 43 is a view showing a seal member in an eighth modification to the crimp terminal of the second embodiment shown in FIGS. 29 to 35.
Figure 44:
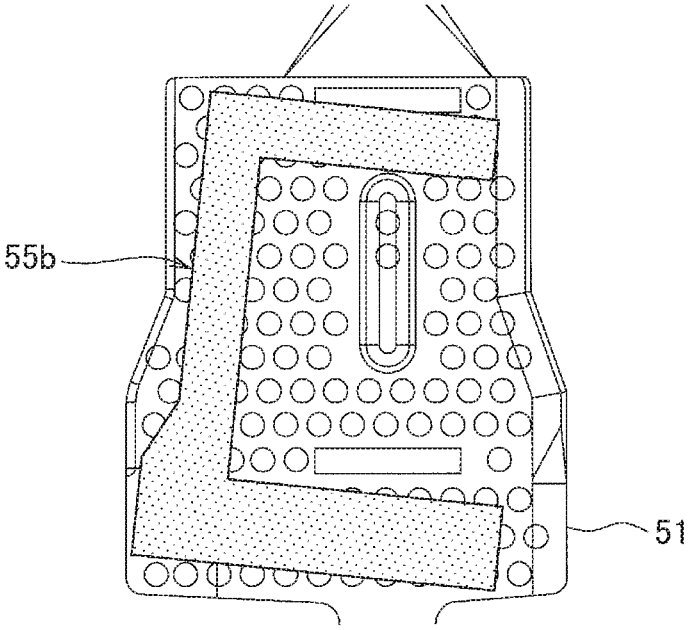
FIG. 44 is a view showing a seal member in a ninth modification to the crimp terminal of the second embodiment shown in FIGS. 29 to 35.
Figure 45:
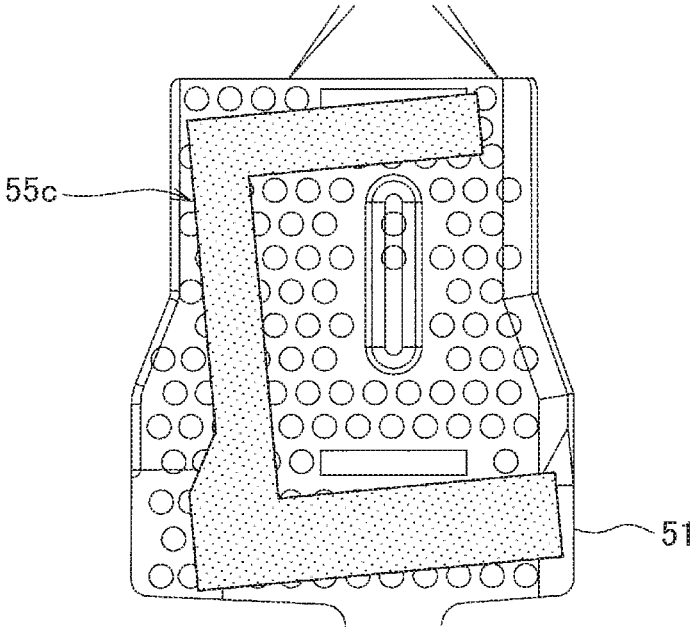
FIG. 45 is a view showing a seal member in a tenth modification to the crimp terminal of the second embodiment shown in FIGS. 29 to 35.
Figure 46:
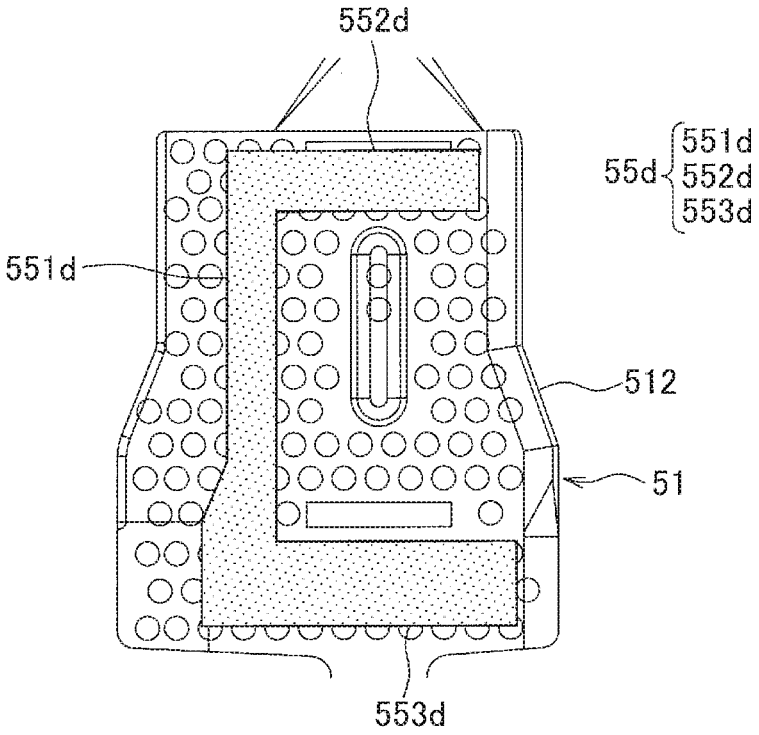
FIG. 46 is a view showing a seal member in an eleventh modification to the crimp terminal of the second embodiment shown in FIGS. 29 to 35.
Figure 47:
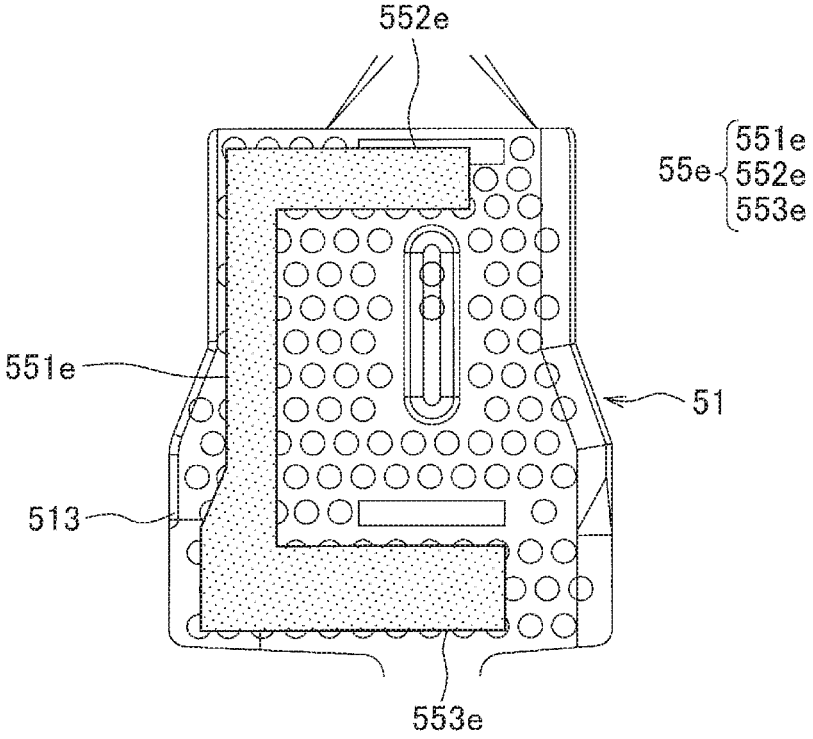
FIG. 47 is a view showing a seal member in a twelfth modification to the crimp terminal of the second embodiment shown in FIGS. 29 to 35.
Figure 48:
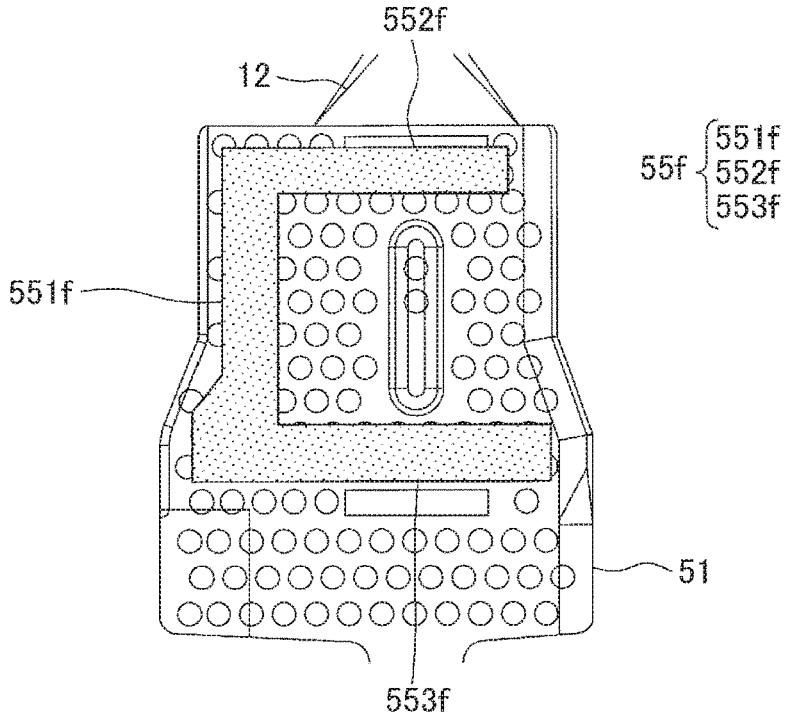
FIG. 48 is a view showing a seal member in a thirteenth modification to the crimp terminal of the second embodiment shown in FIGS. 29 to 35.

FIG. 43 is a view showing a seal member in an eighth modification to the crimp terminal of the second embodiment shown in FIGS. 29 to 35. FIG. 44 is a view showing a seal member in a ninth modification to the crimp terminal of the second embodiment shown in FIGS. 29 to 35. FIG. 45 is a view showing a seal member in a tenth modification to the crimp terminal of the second embodiment shown in FIGS. 29 to 35. FIG. 46 is a view showing a seal member in an eleventh modification to the crimp terminal of the second embodiment shown in FIGS. 29 to 35. FIG. 47 is a view showing a seal member in a twelfth modification to the crimp terminal of the second embodiment shown in FIGS. 29 to 35. FIG. 48 is a view showing a seal member in a thirteenth modification to the crimp terminal of the second embodiment shown in FIGS. 29 to 35.

The seal member 55*a* of the eighth modification shown in FIG. 43 is not divided, and is formed in a C-shape in a plan view connected integrally in which the second seal portion 552*a* and the third seal portion 553*a* are extended in two arms shape from the first seal portion 551*a*.

Each of the modifications shown in FIGS. 44 to 47 described below is a modification of the eighth modification described above.

The sealing member 55*b* of the ninth modification shown in FIG. 44 is C-shaped in plan view and affixed to the barrel section 51 in a state of being inclined clockwise in FIG. 44.

The seal member 55*c* of the tenth modification shown in FIG. 45 is C-shaped in a plan view and affixed to the barrel section 51 in a state of being inclined counterclockwise in FIG. 45.

The seal member 55*d* of the eleventh modification shown in FIG. 46 is formed by connecting the second seal portion 552*d* and the third seal portion 553*d*, which are formed short, with the first seal portion 551*d*. Further, in the eleventh modification, the seal member 55*d* as a whole is affixed in a state biased toward the inner barrel piece 512 of the barrel section 51.

The seal member 55*e* of the twelfth modification shown in FIG. 47 is also formed by connecting the second seal portion 552*e* and the third seal portion 553*e*, which are formed short, with the first seal portion 551*e*. However, in the twelfth modification, the seal member 55*e* as a whole is affixed in a state biased toward the outer barrel piece 513 of the barrel section 51.

The seal member 55*f* of the thirteenth modification shown in FIG. 48 is formed by connecting the second seal portion 552*f* and the third seal portion 553*f* with the first seal portion 551*f* which is formed short. Further, in the thirteenth modification, the seal member 55*f* as a whole is affixed in a state biased toward the terminal section 12 in the barrel section 51.

As described above with various modifications, in the crimp terminal 5 of the second embodiment, even when the integral seal member is used, since the concave sections 514 are formed on substantially the entire surface of the barrel section 51, it is possible to appropriately set the attachment method and the shape thereof with high flexibility.

It is to be noted that the above-described embodiments merely show representative forms of the present invention, and the present invention is not limited to these embodiments. That is, various modifications can be made without departing from the gist of the present invention. As long as the configuration of the present invention is still provided by such a deformation, it is of course within the scope of the present invention.

For example, in the above-described embodiments and various modifications, a mode in which a convex section is provided on the barrel section by press working from the outer surface side is exemplified. However, the barrel section is not limited to this mode, and the convex section may be omitted. However, as described above, by providing the convex section, it is possible to increase the number of contacts with the barrel section by spreading the strands of the aluminum core wire.

Further, in each of the above-described embodiments and various modifications, as one example of a terminal section, a crimp terminal having a terminal section 12 as a female terminal in a square tubular shape is exemplified. However, the terminal section is not limited to this, and it does not require any specific shape nor connection mode.

REFERENCE SIGNS LIST

1, 5 Crimp terminal
11, 51 Barrel section
11*a*, 51*a* Inner surface
11*a*-1, 51*a*-1 First region
11*a*-2, 51*a*-2 Second region
11*a*-3, 51*a*-3 Third region
11*a*-4, 51*a*-4 Path
12 Terminal section
14 Sealing member
111, 511 Bottom plate section
112, 512 Inner barrel piece
113, 513 Outer barrel piece
114, 514 Concave section
115, 515 Convex section
116 Groove section
141 First seal portion
142 Second seal portion
143 Third seal portion
D11 Axial direction
D12 Crossing direction
G11 Gap
W1 Covered electric wire
W1*a* End portion
W11 Aluminum core wire
W12 Covered portion

The invention claimed is:

1. A crimp terminal in which a barrel section to be wound around and crimped to an end portion of a covered electric wire having an aluminum core wire at which the aluminum core wire is exposed, and a terminal section to be connected to a connection object are arranged in a predetermined axial direction, wherein the barrel section includes: a bottom plate section extending in the axial direction, on which the end portion of the covered electric wire is to be placed; and an inner barrel piece and an outer barrel piece extending from the bottom plate portion on both sides in a crossing direction intersecting the axial direction in plan view with respect to the bottom plate portion, the barrel section being configured to wound around the end portion with the inner barrel piece inside while crimping, wherein a plurality of concave sections is dispersedly provided on an inner surface of the barrel section, wherein the crimp terminal includes a sealing member formed from an adhesive gel sheet and affixed across a first region that longitudinally traverses the outer barrel piece in the axial direction, a second region which traverses the inner surface in the crossing direction at a position closer to the terminal section than the aluminum core wire, and a third region that traverses the inner surface in the crossing direction so as to intersect a covered portion of the end portion, and the sealing member seals, after crimping, between the inner barrel piece and the outer barrel piece, an opening of the barrel section which is to be cylindrical on a side of the terminal section, and between the covered portion and the barrel section, and wherein the seal member is affixed in a state of being divided in a halfway of a path from the second region to the third region via the first region.

2. The crimp terminal as claimed in claim 1, wherein the seal member is affixed in a state that the seal member is divided so as to traverse the path in the axial direction.

3. The crimp terminal as claimed in claim 1, wherein the seal member includes: a first seal portion extending in a band shape in the axial direction in the first region, a second seal portion extending in a band shape in the crossing direction in the second region; and a third seal portion extending in a band shape in the crossing direction in the third region, and wherein at least one of the second seal portion and the third seal portion is affixed in a state of being divided from the first seal portion.

4. The crimp terminal as claimed in claim 2, wherein the seal member includes: a first seal portion extending in a band shape in the axial direction in the first region, a second seal portion extending in a band shape in the crossing direction in the second region; and a third seal portion extending in a band shape in the crossing direction in the third region, and wherein at least one of the second seal portion and the third seal portion is affixed in a state of being divided from the first seal portion.

5. A terminal manufacturing method for manufacturing a crimp terminal in which a barrel section to be wound around and crimped to an end portion of a covered electric wire having an aluminum core wire to which the aluminum core wire is exposed, and a terminal section to be connected to a connection object are arranged in a predetermined axial direction, the method comprising:

a sheet metal processing step in which the barrel section is made from a sheet metal with the terminal section, the barrel section including: a bottom plate section extending in the axial direction, on which the end portion of the covered electric wire is to be placed; and an inner barrel piece and an outer barrel piece extending from the bottom plate portion on both sides in a crossing direction intersecting the axial direction in plan view with respect to the bottom plate portion, and wound around the end portion with the inner barrel piece inside while crimping, and a plurality of concave sections is dispersedly provided on an inner surface of the barrel section, and a sealing member affixing step in which a sealing member configured to seal, after crimping, between the inner barrel piece and the outer barrel piece, an opening of the barrel section which is to be cylindrical on a side of the terminal section, and between the covered portion and the barrel section is formed from an adhesive gel sheet, and the sealing member is affixed across a first region that longitudinally traverses the outer barrel piece in the axial direction, a second region which traverses the inner surface in the crossing direction at a position closer to the terminal section than the aluminum core wire, and a third region that traverses the inner surface in the crossing direction so as to intersect a covered portion of the end portion, wherein the sealing member affixing step is a step in which the sealing member is affixed in a state of being divided in a halfway of a path from the second region to the third region via the first region.

* * * * *